US010679508B2

(12) United States Patent
Sakito et al.

(10) Patent No.: US 10,679,508 B2
(45) Date of Patent: Jun. 9, 2020

(54) VEHICLE DETECTION SYSTEM AND VEHICLE DETECTION METHOD

(71) Applicant: Panasonic i-PRO Sensing Solutions Co., Ltd., Fukuoka (JP)

(72) Inventors: Rie Sakito, Saga (JP); Takahiro Yoshimura, Fukuoka (JP); Takeshi Wakako, Fukuoka (JP)

(73) Assignee: PANASONIC I-PRO SENSIG SOLUTIONS CO., LTD., Fukuoka (JP)

( * ) Notice: Subject to any disclaimer, the term of this patent is extended or adjusted under 35 U.S.C. 154(b) by 0 days.

(21) Appl. No.: 16/256,606

(22) Filed: Jan. 24, 2019

(65) Prior Publication Data

US 2020/0051437 A1 Feb. 13, 2020

(30) Foreign Application Priority Data

Aug. 10, 2018 (JP) ..... 2018-151842

(51) Int. Cl.

| | |
|---|---|
| ***G08G 1/01*** | (2006.01) |
| ***G08G 1/00*** | (2006.01) |
| ***G08G 1/056*** | (2006.01) |
| ***G08G 1/017*** | (2006.01) |

(52) U.S. Cl.

CPC ..... *G08G 1/205* (2013.01); *G08G 1/0175* (2013.01); *G08G 1/056* (2013.01)

(58) Field of Classification Search

None

See application file for complete search history.

(56) References Cited

U.S. PATENT DOCUMENTS

| | | | | |
|---|---|---|---|---|
| 9,638,537 | B2 * | 5/2017 | Abramson | G01C 21/3626 |
| 2006/0092043 | A1 * | 5/2006 | Lagassey | G07C 5/008 340/907 |

FOREIGN PATENT DOCUMENTS

| | | |
|---|---|---|
| JP | 2007-174016 | 7/2007 |

* cited by examiner

*Primary Examiner* — Adolf Dsouza

(74) *Attorney, Agent, or Firm* — Seed IP Law Group LLP

(57) ABSTRACT

A vehicle detection system includes a server connected to be able to communicate with a camera installed at an intersection and a client terminal connected to be able to communicate with the server. The client terminal sends, in response to input of information including date and time and a location at which an incident occurred and a feature of a vehicle which caused the incident, an information acquisition request relating to a vehicle which passes through the intersection at the location at the date and time to the server. The server extracts vehicle information and a passing direction of the vehicle passing through the intersection at the location in association with each other based on a captured image of the camera of the camera installed at the intersection at the location at the date and time in response to a reception of the information acquisition request and sends an extraction result to the client terminal. The client terminal displays a visual feature of the vehicle passing through the intersection at the location and the passing direction of the vehicle on a display device.

21 Claims, 29 Drawing Sheets

VEHICLE DETECTION SYSTEM AND VEHICLE DETECTION METHOD

BACKGROUND OF THE INVENTION

1. Field of the Invention

The present disclosure relates to a vehicle detection system and a vehicle detection method for supporting detection of a vehicle or the like using an image captured by a camera.

2. Background Art

A technique is known in which a plurality of cameras are disposed at predetermined locations on a travelling route of a vehicle, and camera image information captured by the respective cameras is displayed on a display device in a terminal device mounted in the vehicle through a network and wireless information exchange device (see JP-A-2007-174016, for example). According to JP-A-2007-174016, a user can obtain a real-time camera image with a large information amount, based on the camera image information captured by the plurality of cameras disposed on the travelling route of the vehicle.

However, in JP-A-2007-174016, it is not considered that, when an incident or accident (hereinafter, referred to as an "incident or the like") occurs at a travelling route (for example, an intersection where many people and vehicles come and go) of a vehicle, a getaway direction of a vehicle or the like causing the incident or the like and visual information such as pictures or images of the vehicle or the like at that time are presented to a user in a state where the getaway direction and the visual information are associated with each other. When an incident or the like occurs, it is important for the initial investigation by the police to grasp the visual features and the way of a getaway vehicle at an early stage. However, in the techniques of the related art so far, clues such as images captured by a camera installed at an intersection and witness information are collected and a police officer grasps the feature and getaway direction of a target getaway vehicle relying on those images and witness information. Therefore, a police officer takes time to grasp the visual features and getaway direction of the getaway vehicle, and thus there is a problem that the initial investigation could be delayed.

SUMMARY OF THE INVENTION

The present disclosure is devised in view of the circumstances of the related art described above and an object thereof is to provide a vehicle detection system and a vehicle detection method which accurately improve the convenience of investigation by police and others by efficiently supporting early grasp of the visual features and getaway direction of a getaway vehicle or the like when an incident or the like occurs at an intersection where many people and vehicles come and go.

The present disclosure provides a vehicle detection system including a server connected to be able to communicate with a camera installed at an intersection, and a client terminal connected to be able to communicate with the server. The client terminal sends, in response to input of information including date and time and a location at which an incident occurred and a feature of a vehicle which caused the incident, an information acquisition request relating to a vehicle which passes through the intersection at the location at the date and time to the server. The server extracts vehicle information and a passing direction of the vehicle passing through the intersection at the location in association with each other based on a captured image of the camera installed at the intersection at the location at the date and time in response to a reception of the information acquisition request and sends an extraction result to the client terminal. The client terminal displays a visual feature of the vehicle passing through the intersection at the location and the passing direction of the vehicle on a display device based on the extraction result.

In addition, the present disclosure also provides a vehicle detection method implemented by a vehicle detection system which includes a server connected to be able to communicate with a camera installed at an intersection and a client terminal connected to be able to communicate with the server. The method includes sending, in response to input of information including date and time and a location at which an incident occurred and a feature of a vehicle which caused the incident, an information acquisition request of a vehicle which passes through the intersection at a location at date and time to the server. The method includes extracting vehicle information and a passing direction of the vehicle passing through the intersection at the location based on a captured image of the camera installed at the intersection at the location in association with each other at the date and time in response to a reception of the information acquisition request and sending an extraction result to the client terminal. The method includes displaying a visual feature of the vehicle passing through the intersection at the location and the passing direction of the vehicle on a display device using the extraction result.

In addition, the present disclosure also provides a vehicle detection system including a server connected to be able to communicate with a camera installed at an intersection, and a client terminal connected to be able to communicate with the server. The client terminal sends, in response to input of information including date and time and a location at which an incident occurred and a feature of a vehicle which caused the incident, an information acquisition request relating to a vehicle which passes through the intersection at the location at the date and time to the server. The server extracts vehicle information and passing directions of a plurality of vehicles which pass through the intersection in association with each other at the location based on a captured image of the camera installed at the intersection at the location at the date and time in response to a reception of the information acquisition request and sends an extraction result to the client terminal. The client terminal creates and outputs a vehicle candidate report including the extraction result and the input information.

In addition, the present disclosure also provides a vehicle detection method implemented by a vehicle detection system which includes a server connected to be able to communicate with a camera installed at an intersection and a client terminal connected to be able to communicate with the server. The method includes sending, in response to input of information including date and time and a location at which an incident occurred and a feature of a vehicle which caused the incident, an information acquisition request of a vehicle which passes through the intersection at the location at the date and time to the server. The method includes extracting vehicle information and passing directions of a plurality of vehicles which pass through the intersection at the location in association with each other based on captured image of the camera installed at the intersection at the location at the date and time in response to a reception of the information acquisition request and sending an extraction result to the client terminal. The method includes creating and outputting a vehicle candidate report including the extraction result and the input information.

According to the present disclosure, when an incident or the like occurs at an intersection where many people and vehicles come and go, it is possible to efficiently support early grasp of the visual features and getaway direction of a getaway vehicle or the like, and thus it is possible to accurately improve the convenience of investigation by police and others.

DETAILED DESCRIPTION OF THE EXEMPLARY EMBODIMENT

Background to First Embodiment

In JP-A-2007-174016, it is not considered that, when an incident or the like occurs at a travelling route (for example, an intersection where many people and vehicles come and go) of a vehicle, a getaway direction of a vehicle or the like causing the incident or the like and visual information such as pictures or images of the vehicle or the like at that time are presented to a user in a state where the getaway direction and the visual information are associated with each other. When an incident or the like occurs, it is important for the initial investigation by the police to grasp the visual features and the way of a getaway vehicle at an early stage. However, in the techniques of the related art so far, clues such as images captured by a camera installed at an intersection and witness information are collected and a police officer grasps the feature and getaway direction of a target getaway vehicle relying on those images and witness information. Therefore, it takes time for a police officer to grasp the visual features and getaway direction of the getaway vehicle, and thus there is a problem that the initial investigation might be delayed.

Therefore, in a first embodiment described below, an example of a vehicle detection system and a vehicle detection method which accurately improve the convenience of investigation by police and others by efficiently supporting early grasp of the visual features and getaway direction of a getaway vehicle or the like when an incident or the like occurs at an intersection where many people and vehicles come and go is described.

First Embodiment

Hereinafter, an embodiment in which a vehicle detection system and a vehicle detection method according to the present disclosure are specifically disclosed will be described in detail with reference to the accompanying drawings as appropriate. However, more detailed explanation than necessary may be omitted. For example, detailed explanations of already well-known matters and redundant explanation on the substantially same configuration may be omitted. This is to avoid the following description from being unnecessarily lengthy and to facilitate understanding by those skilled in the art. The accompanying drawings and the following description are provided to enable those skilled in the art to sufficiently understand the present disclosure and it is not intended that they limit the claimed subject matters.

Hereinafter, an example of assisting the investigation by a police officer who tracks a vehicle (that is, a getaway vehicle) on which a person such as a suspect who caused an incident (for example, an incident or an accident) or the like at an intersection where many people and vehicles come and go or a vicinity thereof rides with the vehicle detection system is described.

Figure 1:
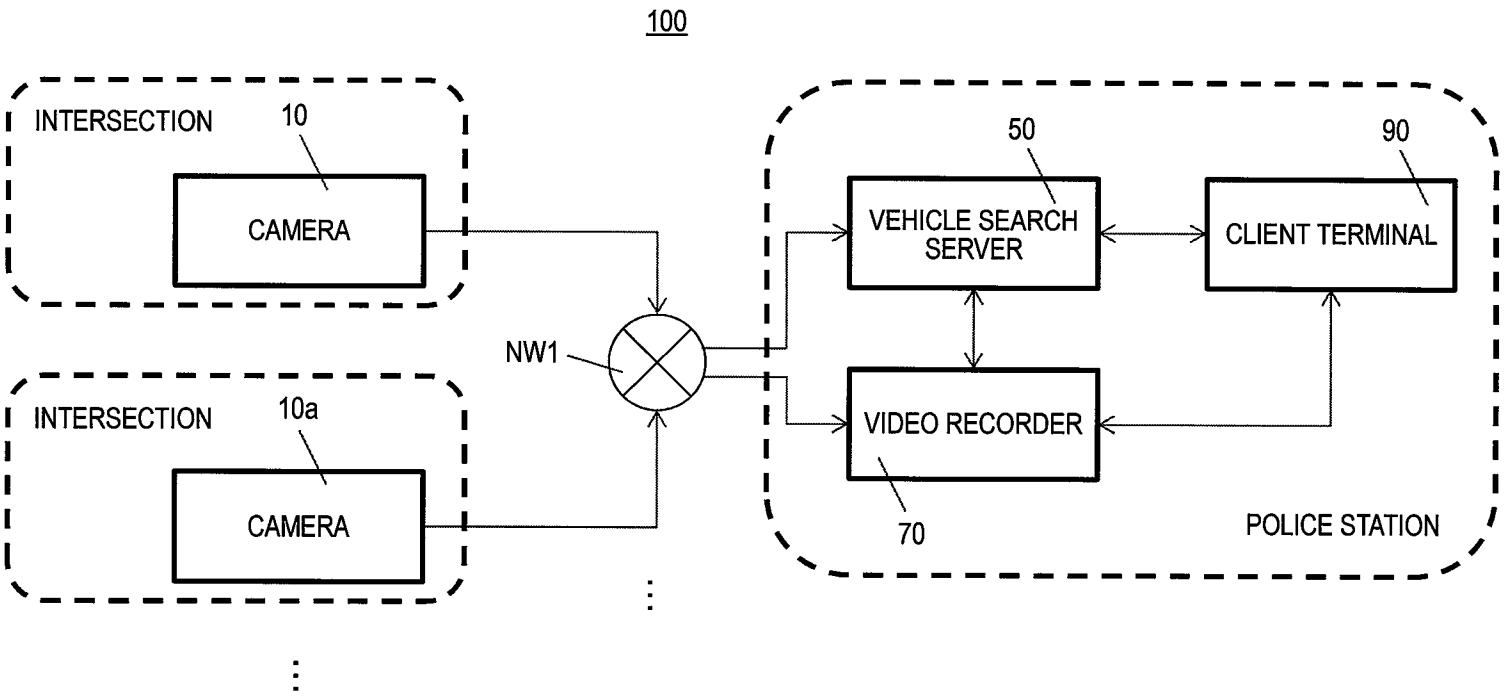
FIG. 1 is a block diagram illustrating a system configuration example of a vehicle detection system.

FIG. 1 is a block diagram illustrating a system configuration example of a vehicle detection system 100. The vehicle detection system 100 as an example of vehicle and the like detection system is constituted to include a camera installed corresponding to each intersection, and a vehicle search server 50, a video recorder 70 and a client terminal 90, the latter three elements being installed in a police station. In the following description, the video recorder 70 may be provided as an on-line storage connected to the vehicle search server 50 via a communication line such as the Internet, instead of on-premises management in the police station.

In the vehicle detection system 100, one camera (for example, camera 10) is installed for one intersection. For one intersection, a plurality of cameras (for example, cameras 10 or cameras with an internal configuration different from that of the camera 10) may be installed. Therefore, the camera 10 is installed at a certain intersection and a camera 10*a* is installed at another intersection. Further, the internal configurations of the cameras 10, 10*a*, . . . are the same. The cameras 10, 10*a*, . . . are respectively connected to be able to communicate with each of the vehicle search server 50 and the video recorder 70 in the police station via a network NW1 such as an intranet communication line. The network NW 1 is constituted by a wired communication line (for example, an optical communication network using an optical fiber), but it may also be constituted by a wireless communication network.

Each of the cameras 10, 10*a*, . . . is a surveillance camera capable of capturing an image of a subject (for example, an image showing the situation of an intersection) with an imaging angle of view set when it is installed at the intersection and sends data of the captured image to each of the vehicle search server 50 and the video recorder 70. The data of the captured image is not limited to data of only a captured image but includes identification information (in other words, position information on an intersection where the corresponding camera is installed) of the camera which captured the captured image and information on the capturing date and time.

The vehicle search server 50 (an example of a server) is installed in a police station, for example, receives data of captured images respectively sent from the cameras 10, 10*a*, . . . installed at all or a part of intersections within the jurisdiction of the police station, and temporarily holds (that is, saves) the data in a memory 52 or a storage unit 56 (see FIG. 6) for various processes by a processor PRC1. Every time the held data of the captured image is sent from each of the cameras 10, 10*a*, . . . and received by the vehicle search server 50, video analysis is performed by the vehicle search server 50 and the data is used for acquiring detailed information on the incident and the like. Further, when an event such as an incident occurs, the held data of the captured image is subjected to video analysis by the vehicle search server 50 based on a vehicle information request from the client terminal 90 and used for acquiring detailed information on the incident or the like. The vehicle search server 50 may send some captured images (for example, captured images (for example, captured images of an important incident or a serious incident) specified by an operation of a terminal (not illustrated) used by an administrator in the police station) to the video recorder 70 for storage. The vehicle search server 50 may acquire tag information (for example, person information such as the face of a person appearing in the captured image or vehicle information such as a car type, a car style, a car color, and the like) relating to the content of the image as a result of the video analysis described above, attach the tag information to the data of the captured images connectively, and accumulate it to the storage unit 56.

The client terminal 90 is installed in, for example, a police station and is used by officials (that is, a policeman who is a user in the police station) in the police station. The client terminal 90 is a laptop or notebook type Personal Computer (PC), for example. When, for example, an incident or the like occurs, from the telephone call from a notifying person who informed the police station of the occurrence of the incident or the like, a user inputs various pieces of information relating to the incident or the like as witness information (see below) by operating the client terminal 90 and records it. Further, the client terminal 90 is not limited to the PC of the type described above and may be a computer having a communication function such as a smartphone, a tablet terminal, a Personal Digital Assistant (PDA), or the like. The client terminal 90 sends a vehicle information request to the vehicle search server 50 to cause the vehicle search server 50 to search for a vehicle (that is, a getaway vehicle on which a person such as a suspect who caused the incident or the like rides) matching the witness information described above, receives the search result, and displays it on a display 94.

The video recorder 70 is installed in, for example, the police station, receives data of the captured images sent respectively from the cameras 10, 10*a*, . . . installed at all or a part of the intersections within the jurisdiction of the police station, and saves them for backup or the like. The video recorder 70 may send the held data of the captured images of the cameras to the client terminal 90 according to a request from the client terminal 90 according to an operation by a user. The vehicle search server 50, the video recorder 70, and the client terminal 90 installed in the police station are connected to be able to communicate with one another via a network NW2 such as an intranet in the police station.

Only one vehicle search server 50, one video recorder 70, and one client terminal 90 installed in the police station are illustrated in FIG. 1, but a plurality of them may be provided. Also, in a case of the police station, a plurality of police stations may be included in the vehicle detection system 100.

Figure 2:
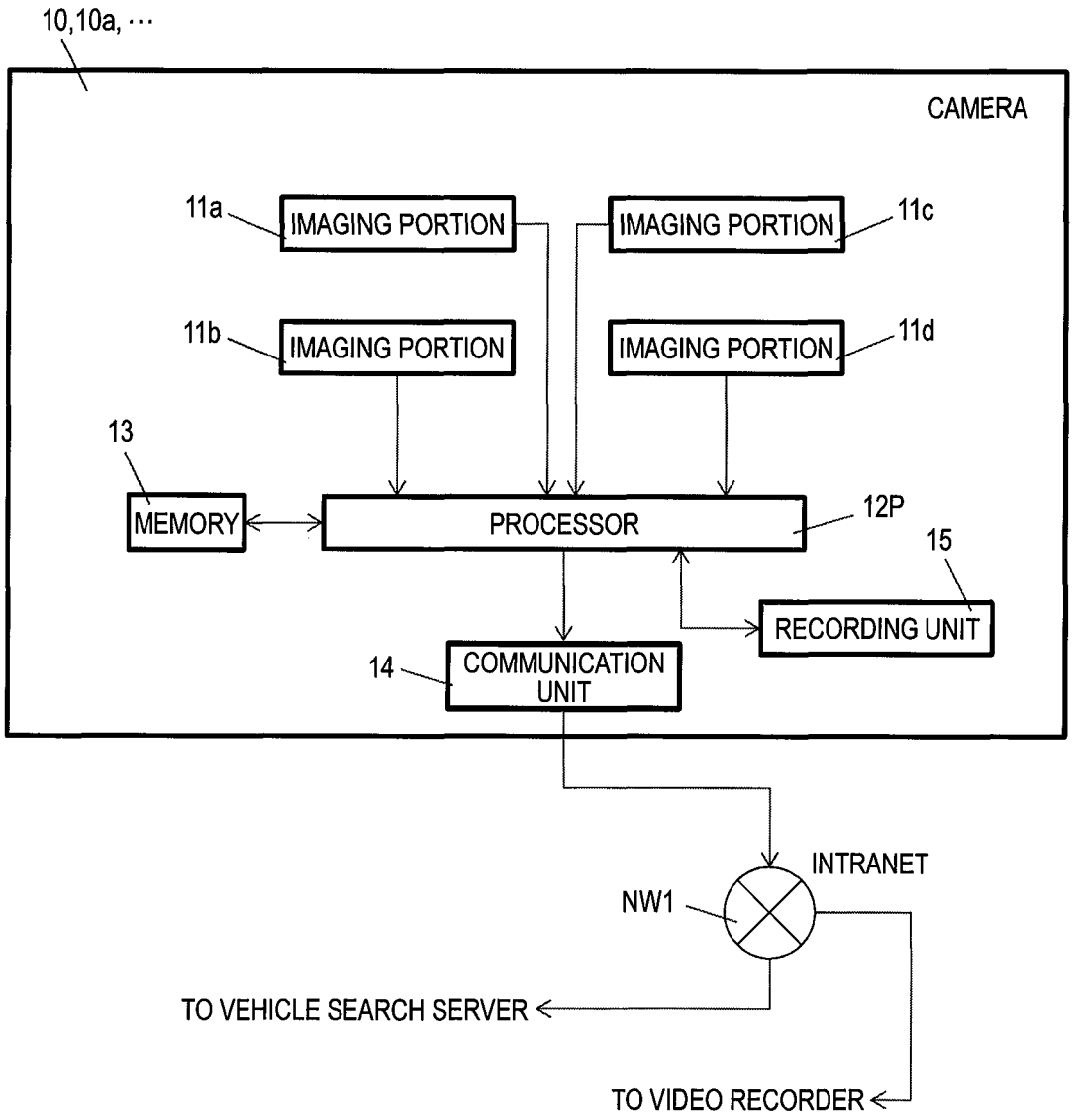
FIG. 2 is a block diagram illustrating an internal configuration example of a camera.
Figure 3:
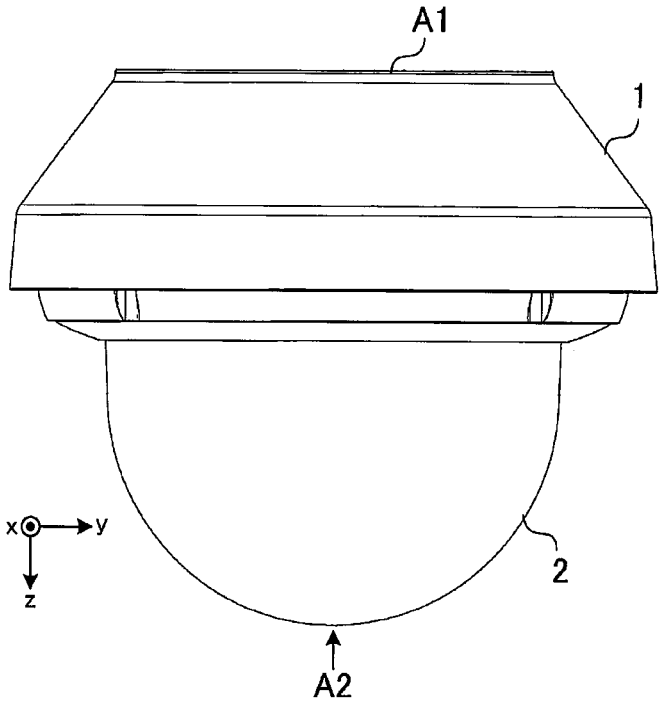
FIG. 3 is a side view of the camera.
Figure 4:
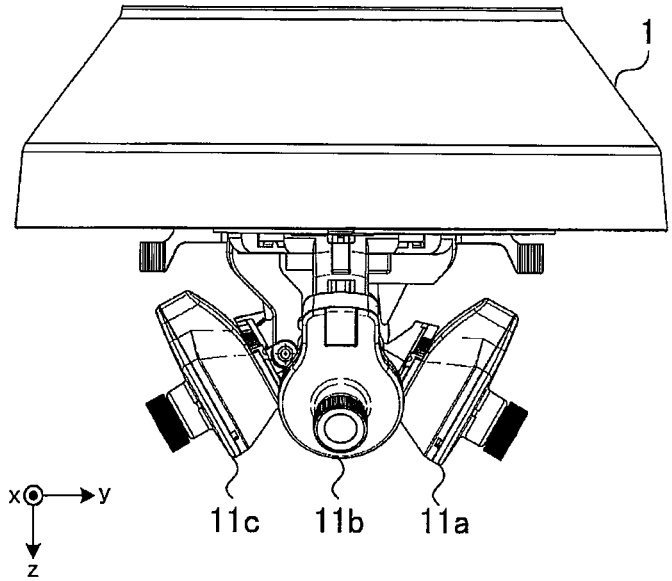
FIG. 4 is a side view of the camera with a cover removed.
Figure 5:
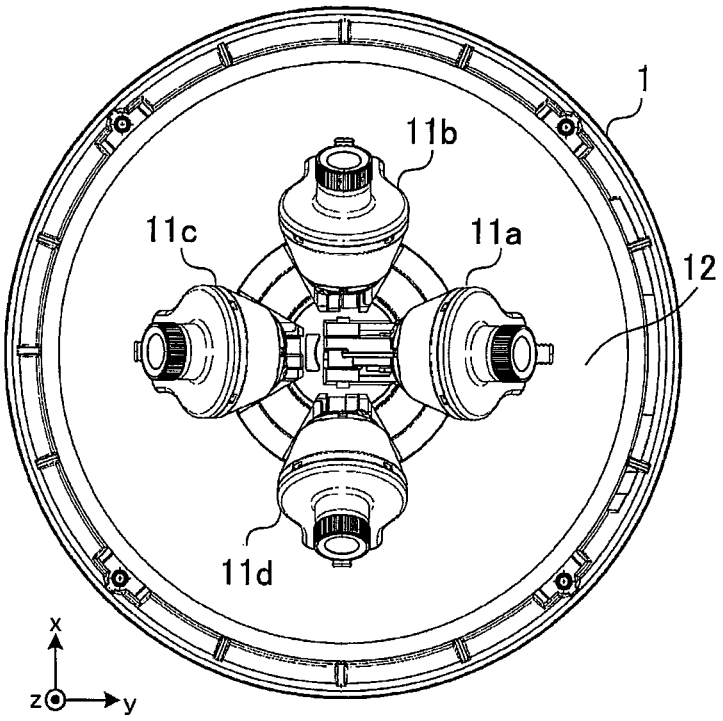
FIG. 5 is a front view of the camera with the cover removed.

FIG. 2 is a block diagram illustrating an internal configuration example of the cameras 10, 10*a*, . . . . As described above, the respective cameras 10, 10*a*, . . . have the same configuration, so the camera 10 will be exemplified below. FIG. 3 is a side view of the camera. FIG. 4 is a side view of the camera in a state where a cover is removed. FIG. 5 is a front view of the camera in a state where the cover is removed. The cameras 10, 10*a*, . . . are not limited to those having the appearance and structure illustrated in FIGS. 3 to 5.

First, the appearance and mechanism of the camera 10 will be described with reference to FIGS. 3 to 5. The camera 10 illustrated in FIG. 3 is fixedly installed on, for example, a pillar of a traffic light installed at an intersection or a telegraph pole. Hereinafter, coordinate axes of three axes illustrated in FIG. 3 are set with respect to the camera 10.

As illustrated in FIG. 3, the camera 10 has a housing 1 and a cover 2. The housing 1 has a fixing surface A1 at the bottom. The camera 10 is fixed to, for example, a pillar of a traffic light or a telegraph pole via the fixing surface A1.

The cover 2 is, for example, a dome type cover and has a hemispherical shape. The cover 2 is made of a transparent material such as glass or plastic, for example. The portion indicated by the arrow A2 in FIG. 3 indicates the zenith of the cover 2.

The cover 2 is fixed to the housing 1 so as to cover a plurality of imaging portions (see FIG. 4 or 5) attached to the housing 1. The cover 2 protects a plurality of imaging portions 11*a*, 11*b*, 11*c*, and 11*d* attached to the housing 1.

In FIG. 4, the same reference numerals and characters are given to the same components as those in FIG. 3. As illustrated in FIG. 4, the camera 10 has the plurality of imaging portions 11*a*, 11*b*, and 11*c*. The camera 10 has four imaging portions. However, in FIG. 4, another imaging portion 11*d* is hidden behind (that is, in a −x axis direction) the imaging portion 11*b*.

In FIG. 5, the same reference numerals and characters are given to the same components as those in FIG. 3. As illustrated in FIGS. 2 and 5, the camera 10 has four imaging portions 11*a*, 11*b*, 11*c*, and 11*d*. Imaging directions (for example, a direction extending perpendicularly from a lens surface) of the imaging portions 11*a* to 11*d* are adjusted by the user's hand.

The housing 1 has a base 12. The base 12 is a plate-shaped member and has a circular shape when viewed from the front (+z axis direction) of the apparatus. The imaging portions 11*a* to 11*d* are movably fixed (connected) to the base 12 as will be described in detail below.

The center of the base 12 is located right under the zenith of the cover 2 (directly below the zenith). For example, the center of the base 12 is located directly below the zenith of the cover 2 indicated by the arrow A2 in FIG. 3.

As illustrated in FIG. 2, the camera 10 is constituted to include four imaging portions 11*a* to 11*d*, a processor 12P, a memory 13, a communication unit 14, and a recording unit 15. Since the camera 10 has four imaging portions 11*a* to 11*d*, it is a multi-sensor camera having an imaging angle of view in four directions (see FIG. 5). However, in the first embodiment, for example, two imaging portions (for example, imaging portions 11*a* and 11*c*) arranged opposite to each other are used. This is because the imaging portion 11*a* images in a wide area so as to be able to image the entire range of the intersection and the imaging portion 11*c* images so as to supplement the range (for example, an area where a pedestrian walks on a lower side in a vertical direction from the installation position of the camera 10) of the dead angle of the imaging angle of view of the imaging portion 11*a*. At least two of the imaging portions 11*a* and 11*c* may be used, and furthermore, either or both of the imaging portions 11*b* and 11*d* may be used.

Since the imaging portions 11*a* to 11*d* have the same configuration, the imaging portion 11*a* will be exemplified and explained. The imaging portion 11*a* has a configuration including a condensing lens and a solid-state imaging device such as a Charge Coupled Device (CCD) type image sensor or a Complementary Metal Oxide Semiconductor (CMOS) type image sensor. While the camera 10 is powered on, the imaging portion 11*a* always outputs the data of the captured image of the subject obtained based on the image captured by the solid-state imaging device to the processor 12P. In addition, each of the imaging portions 11*a* to 11*d* may be provided with a mechanism for changing the zoom magnification at the time of imaging.

The processor 12P is constituted using, for example, a Central Processing Unit (CPU), a Micro Processing Unit (MPU), a Digital Signal Processor (DSP), or a Field-Programmable Gate Array (FPGA). The processor 12P functions as a control unit of the camera 10 and performs control processing for totally supervising the operation of each part of the camera 10, input/output processing of data with each part of the camera 10, calculation processing of data, and storage processing of data. The processor 12P operates in accordance with programs and data stored in the memory 13. The processor 12P uses the memory 13 during operation. Further, the processor 12P acquires the current time information, performs various known image processing on the captured image data captured by the imaging portions 11*a* and 11*c*, respectively, and records the data in the recording unit 15. Although not illustrated in FIG. 2, when the camera 10 has a Global Positioning System (GPS) receiving unit, the current position information may be acquired from the GPS receiving unit and the data of the captured image may be recorded in association with the position information.

Here, the GPS receiving unit will be briefly described. The GPS receiving unit receives satellite signals including the signal transmission time and position coordinates and transmitted from a plurality of GPS transmitters (for example, four navigation satellites). The GPS receiving unit calculates the current position coordinates of the camera and the reception time of the satellite signal by using a plurality of satellite signals. This calculation may be executed not by the GPS receiving unit but by the processor 12P to which the output from the GPS receiving unit is input. The reception time information may also be used to correct the system time of the camera. The system time is used for recording, for example, the imaging time of the captured picture constituting the captured image.

Further, the processor 12P may variably control the imaging conditions (for example, the zoom magnification) by the imaging portions 11*a* to 11*d* according to an external control command received by the communication unit 14. When an external control command instructs to change, for example, the zoom magnification, in accordance with the control command, the processor 12P changes the zoom magnification at the time of imaging of the imaging portion instructed by the control command.

In addition, the processor 12P repeatedly sends the data of the captured image recorded in the recording unit 15 to the vehicle search server 50 and the video recorder 70 via the communication unit 14. Here, repeatedly sending is not limited to transmitting every time a fixed period of time passes and may include transmitting every time not only fixed period but a predetermined irregular time interval elapses, including transmitting a plurality of times.

The memory 13 is constituted using, for example, a Random Access Memory (RAM) and a Read Only Memory (ROM) and temporarily stores programs and data necessary for executing the operation of the camera 10, and further information, data, or the like generated during operation. The RAM is, for example, a work memory used when the processor 12P is in operation. The ROM stores, for example, a program and data for controlling the processor 12P in advance. Further, the memory 13 stores, for example, identification information (for example, serial number) for identifying the camera 10 and various setting information.

The communication unit 14 sends the data of the captured image recorded in the recording unit 15 to the vehicle search server 50 and the video recorder 70 respectively via the network NW1 described above based on the instruction of the processor 12P. Further, the communication unit 14 receives the control command of the camera 10 sent from the outside (for example, the vehicle search server 50) and transmits the state information on the camera 10 to the outside (for example, the vehicle search server 50).

The recording unit 15 is constituted by using a semiconductor memory (for example, flash memory) incorporated in the camera 10 or an external storage medium such as a memory card (for example, an SD card) not incorporated in the camera 11. The recording unit 15 records the data of the captured image generated by the processor 12P in association with the identification information (an example of the camera information) of the camera 10 and the information on the imaging date and time. The recording unit 15 always pre-buffers and holds the data of the captured image for a predetermined time (for example, 30 seconds) and continuously accumulates the data while overwriting the data of the captured image up to a predetermined time (for example, 30 seconds) before the current time. When the recording unit 15 is constituted by a memory card, it is detachably mounted on the housing of the camera 10.

Figure 6:
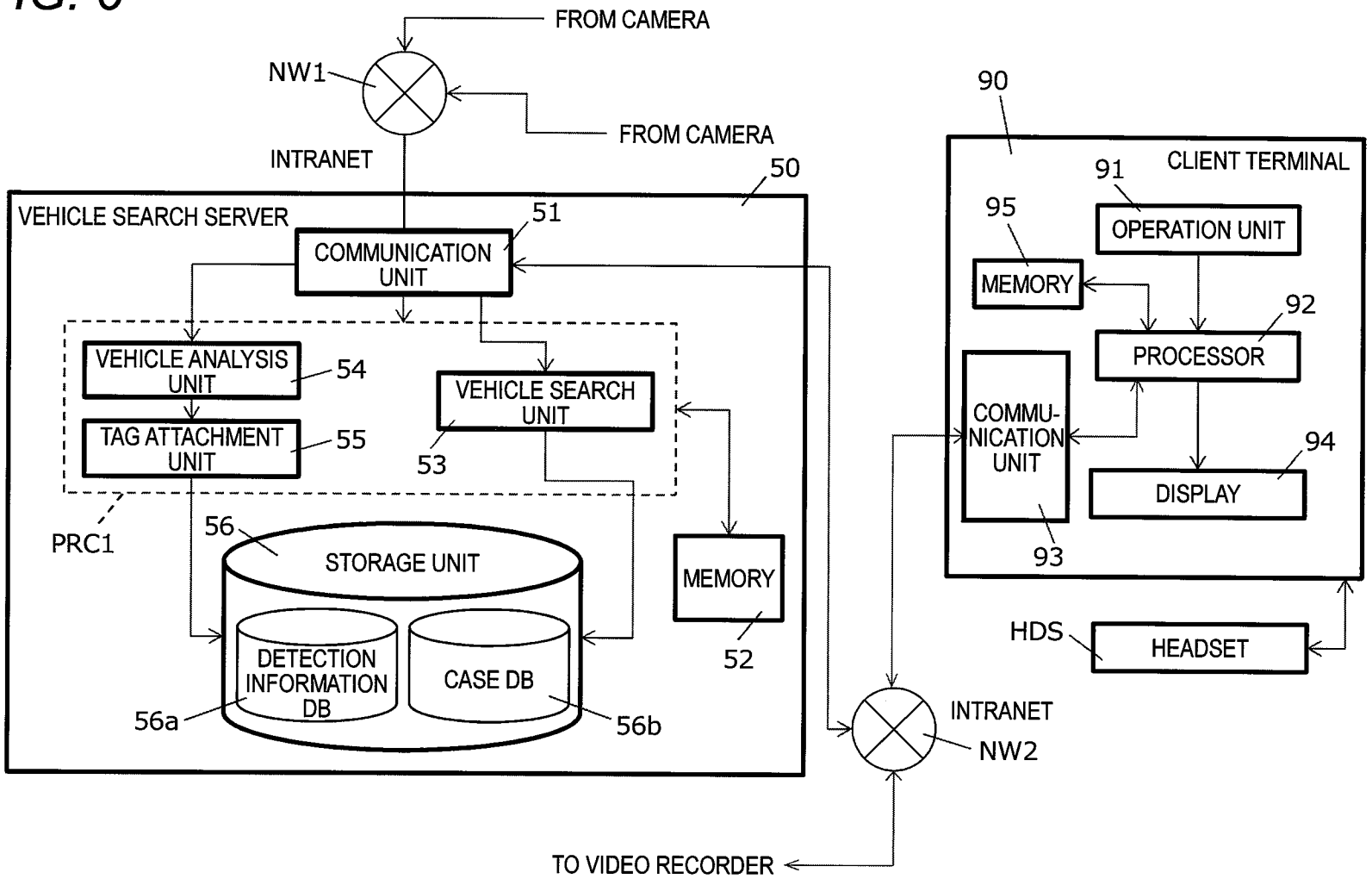
FIG. 6 is a block diagram illustrating an internal configuration example of each of a vehicle search server and a client terminal.

FIG. 6 is a block diagram illustrating an internal configuration example of each of the vehicle search server 50 and the client terminal 90. The vehicle search server 50, the client terminal 90, and the video recorder 70 are connected by using an intranet such as a wired Local Area Network (LAN) provided in the police station, but they may be connected via a wireless network such as a wireless LAN.

The vehicle search server 50 is constituted including a communication unit 51, a memory 52, a vehicle search unit 53, a vehicle analysis unit 54, a tag attachment unit 55, and the storage unit 56. The vehicle search unit 53, the vehicle analysis unit 54, and the tag attachment unit 55 are constituted by a processor PRC 1 such as a CPU, an MPU, a DSP, and an FPGA.

The communication unit 51 communicates with the cameras 10, 10*a*, . . . connected via the network NW1 such as an intranet and receives the data of captured images (that is, images showing the situation of intersections) sent respectively from the cameras 10, 10*a*, . . . . Further, the communication unit 51 communicates with the client terminal 90 via the network NW2 such as an intranet provided in the police station. The communication unit 51 receives the vehicle information request sent from the client terminal 90 or transmits a response to the vehicle information request. Further, the communication unit 51 sends the data of the captured image held in the memory 52 or the storage unit 56 to the video recorder 70.

The memory 52 is constituted using, for example, a RAM and a ROM and temporarily stores programs and data necessary for executing the operation of the vehicle search server 50, and further information or data generated during operation. The RAM is, for example, a work memory used when the processor PRC1 operates. The ROM stores, for example, a program and data for controlling the processor PRC1 in advance. Further, the memory 52 stores, for example, identification information (for example, serial number) for identifying the vehicle search server 50 and various setting information.

Based on the vehicle information request sent from the client terminal 90, the vehicle search unit 53 searches for vehicle information which matches the vehicle information request from the data stored in the storage unit 56. The vehicle search unit 53 extracts and acquires the search result of the vehicle information matching the vehicle information request. The vehicle search unit 53 sends the data of the search result (extraction result) to the client terminal 90 via the communication unit 51.

The vehicle analysis unit 54 sequentially analyzes the stored data of the captured images each time the data of the captured image from each of the cameras 10, 10 *a*, . . . is stored in the storage unit 56 and extracts and acquires information (vehicle information) relating to a vehicle (in other words, the vehicle which has flowed in and out of the intersection where the camera is installed) appearing in the captured image. The vehicle analysis unit 54 acquires, as the vehicle information, information such as a car type, a car style, a car color, a license plate, and the like of a vehicle, information on a person who rides on the vehicle, the number of passengers, the travelling direction (specifically, the flow-in direction to the intersection and the flow-out direction from the intersection) of the vehicle when it passes through the intersection and sends it to the tag attachment unit 55. The vehicle analysis unit 54 is capable of determining the travelling direction when a vehicle passes through the intersection based on, for example, a temporal difference between frames of a plurality of captured images. The travelling direction indicates, for example, that the vehicle has passed through the intersection via any one of the travelling, straight advancing, left turning, right turning, or turning.

The tag attachment unit 55 associates (an example of tagging) the vehicle information obtained by the vehicle analysis unit 54 with the imaging date and time and the location (that is, the position of the intersection) of the captured image which are used for analysis by the vehicle analysis unit 54 and records them in a detection information DB (Database) 56*a* of the storage unit 56. Therefore, the vehicle search server 50 can clearly determine what kind of vehicle information is given to a captured image captured at a certain intersection at a certain time. The processing of the tag attachment unit 55 may be executed by the vehicle analysis unit 54, and in this case, the configuration of the tag attachment unit 55 is not necessary.

The storage unit 56 is constituted using, for example, a Hard Disk Drive (HDD) or a Solid State Drive (SSD). The storage unit 56 records the data of the captured images sent from the cameras 10, 10*a*, . . . in association with the identification information (in other words, the position information on the intersection where the corresponding camera is installed) of the camera which has captured the captured image and the information on the imaging date and time. The storage unit 56 also records information on road maps indicating the positions of intersections where the respective cameras 10, 10*a*, . . . are installed and records information on the updated road map each time the information on the road map is updated by, for example, new construction of a road, maintenance work, or the like. In addition, the storage unit 56 records intersection camera installation data indicating the correspondence between one camera installed at each intersection and the intersection. In the intersection camera installation data, for example, identification information on the intersection and identification information on the camera are associated with each other. Therefore, the storage unit 56 records the data of the captured image of the camera in association with the information on the imaging date and time, the camera information, and the intersection information. The information on the road map is recorded in a memory 95 of the client terminal 90.

The storage unit 56 also has the detection information DB 56*a* and a case DB 56*b*.

The detection information DB 56*a* stores the output (that is, a set of the vehicle information obtained as a result of analyzing the captured image of the camera by the vehicle analysis unit 54 and the information on the date and time and the location of the captured image used for the analysis) of the tag attachment unit 55. The detection information DB 56*a* is referred to when the vehicle search unit 53 extracts vehicle information matching the vehicle information request, for example.

The case DB 56*b* registers and stores witness information such as the date and time and the location when the case occurred and detailed case information such as vehicle information as a search result of the vehicle search unit 53*b* based on the witness information for each case such as an incident. The detailed case information includes, for example, case information such as the date and time and the location when the case occurred, a vehicle thumbnail image of the searched vehicle, the rank of a suspect candidate mark, surrounding map information including the point where the case occurred, the flow-in/flow-out direction of the vehicle with respect to the intersection, the intersection passing time of the vehicle, and the user's memo. Further, the detailed case information is not limited to the contents described above.

The client terminal 90 is constituted including an operation unit 91, a processor 92, a communication unit 93, the display 94, the memory 95, and a recording unit 96. The client terminal 90 is used by officials (that is, police officers who are users) in the police station. When there is a telephone call for notifying the occurrence of an incident or the like by a witness or the like of the incident, a user wears the headset HDS and answers the telephone. The headset HDS is used while being connected to the terminal 90, receives voice of a user, and outputs voice of a caller (that is, notifying person).

The operation unit 91 is a User Interface (UI) for detecting the operation of a user and is constituted using a mouse, a keyboard, or the like. The operation unit 91 outputs a signal based on the operation of a user to the processor 92. When, for example, it is desired to confirm the captured image of the intersection at the date and time and the location at which a case such as an incident investigated by a user occurred, the operation unit 91 accepts input of a search condition including the date and time, the location, and the features of a vehicle.

The processor 92 is constituted using, for example, a CPU, an MPU, a DSP, or an FPGA and functions as a control unit of the client terminal 90. The processor 92 performs control processing for totally supervising the operation of each part of the client terminal 90, input/output processing of data with each part of the client terminal 90, calculation processing of data, and storage processing of data. The processor 92 operates according to the programs and data stored in the memory 95. The processor 92 uses the memory 95 during operation. Further, the processor 92 acquires the current time information and displays the search result of a vehicle sent from the vehicle search server 50 or the captured image sent from the video recorder 70 on the display 94. In addition, the processor 92 creates a vehicle acquisition request including the search conditions (see above) input by the operation unit 91 and transmits the vehicle acquisition request to the vehicle search server 50 via the communication unit 93.

The communication unit 93 communicates with the vehicle search server 50 or the video recorder 70 connected via the network NW2 such as an intranet. For example, the communication unit 93 transmits the vehicle acquisition request created by the processor 92 to the vehicle search server 50 and receives the search result of the vehicle information sent from the vehicle search server 50. Also, the communication unit 93 transmits an acquisition request of captured images created by the processor 92 to the video recorder 70 and receives captured images sent from the video recorder 70.

The display 94 is constituted using a display device such as a Liquid Crystal Display (LCD), an organic Electroluminescence (EL) or the like, and displays various data sent from the processor 92.

The memory 95 is constituted using, for example, a RAM and a ROM and temporarily stores programs and data necessary for executing the operation of the client terminal 90, and further information or data generated during operation. The RAM is a work memory used during, for example, the operation of the processor 92. The ROM stores, for example, programs and data for controlling the processor 92 in advance. Further, the memory 95 stores, for example, identification information (for example, a serial number) for identifying the client terminal 90 and various setting information.

The recording unit 96 is constituted using, for example, a hard disk drive or a solid state drive. The recording unit 96 also records information on road maps indicating the positions of intersections where the respective cameras 10, 10*a*, . . . are installed and records information on the updated road map each time the information on the road map is updated by, for example, new construction of a road, maintenance work, or the like. In addition, the recording unit 96 records intersection camera installation data indicating the correspondence between one camera installed at each intersection and the intersection. In the intersection camera installation data, for example, identification information on the intersection and identification information on the camera are associated with each other. Accordingly, the recording unit 96 records the data of the image captured by the camera in association with the information on the imaging date and time, the camera information, and the intersection information.

Figure 7:
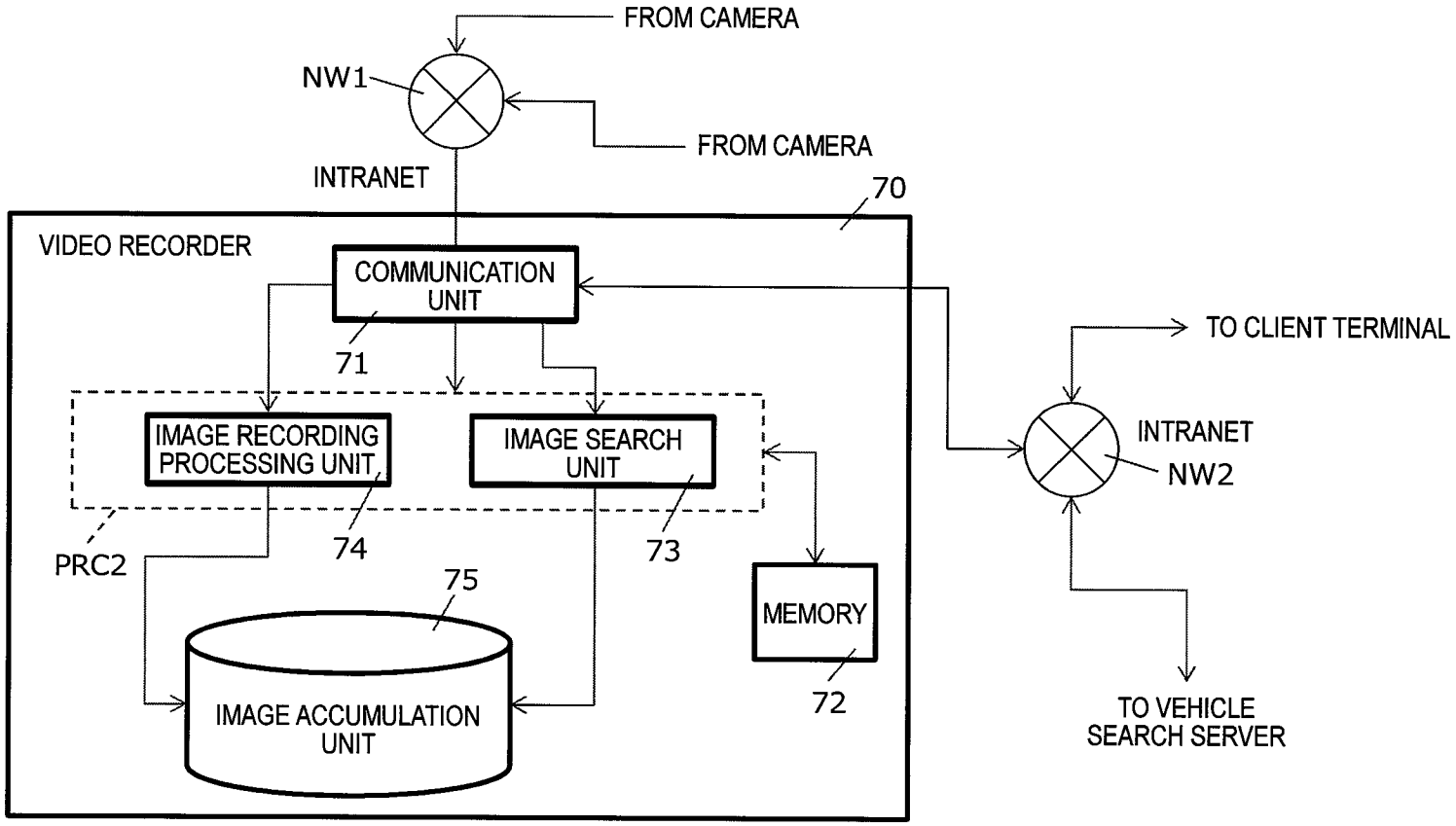
FIG. 7 is a block diagram illustrating an internal configuration example of a video recorder.

FIG. 7 is a block diagram illustrating an internal configuration example of the video recorder 70. The video recorder 70 is connected so as to be able to communicate with the cameras 10, 10*a*, . . . via the network NW1 such as an intranet and connected so as to be able to communicate with the vehicle search server 50 and the client terminal 90 via the network NW2 such as an intranet.

The video recorder 70 is constituted including a communication unit 71, a memory 72, an image search unit 73, an image recording processing unit 74, and an image accumulation unit 75. The image search unit 73 and the image recording processing unit 74 are constituted by a processor PRC2 such as a CPU, an MPU, a DSP, and an FPGA, for example.

The communication unit 71 communicates with the cameras 10, 10*a*, . . . connected via the network NW1 such as an intranet and receives the data of captured images (that is, images showing the situation of the intersection) sent from the cameras 10, 10*a*, . . . . Further, the communication unit 71 communicates with the client terminal 90 via the network NW2 such as an intranet provided in the police station. The communication unit 71 receives an image request sent from the client terminal 90 and transmits a response to the image request.

The memory 72 is constituted using, for example, a RAM and a ROM and temporarily stores programs and data necessary for executing the operation of the video recorder 70, and further information, data, or the like generated during operation. The RAM is, for example, a work memory used when the processor PRC2 is in operation. The ROM stores, for example, a program and data for controlling the processor PRC2 in advance. Further, the memory 72 stores, for example, identification information (for example, serial number) for identifying the video recorder 70 and various setting information.

Based on the image request sent from the client terminal 90, the image search unit 73 extracts the captured image of the camera matching the image request by searching the image accumulation unit 75. The image search unit 73 sends the extracted data of the captured image to the client terminal 90 via the communication unit 71.

Each time the data of the captured images from each of the cameras 10, 10*a*, . . . is received by the communication unit 71, the image recording processing unit 74 records the received data of the captured images in the image accumulation unit 75.

The image accumulation unit 75 is constituted using, for example, a hard disk or a solid state drive. The image accumulation unit 75 records the data of the captured images sent from each of the cameras 10, 10*a*, . . . in association with the identification information (in other words, the position information on the intersection where the corresponding camera is installed) of the camera which has captured the captured image and the information on the imaging date and time.

Next, various screens displayed on the display 94 of the client terminal 90 at the time of investigation by a police officer who is a user of the first embodiment will be described with reference to FIGS. 6 to 19. In the description of FIGS. 6 to 19, the same reference numerals and characters are used for the same components as those illustrated in the drawings and the description thereof is simplified or omitted.

In the investigation, the client terminal 90 executes and activates a preinstalled vehicle detection application (hereinafter, referred to as "vehicle detection application") by the operation of a user (police officer). The vehicle detection application is stored in the ROM of the memory 95 of the client terminal 90, for example, and executed by the processor 92 when it is activated by the operation of a user. Various data or information created by the processor 92 during the activation of the vehicle detection application is temporarily held in the RAM of the memory 95.

Figure 8:
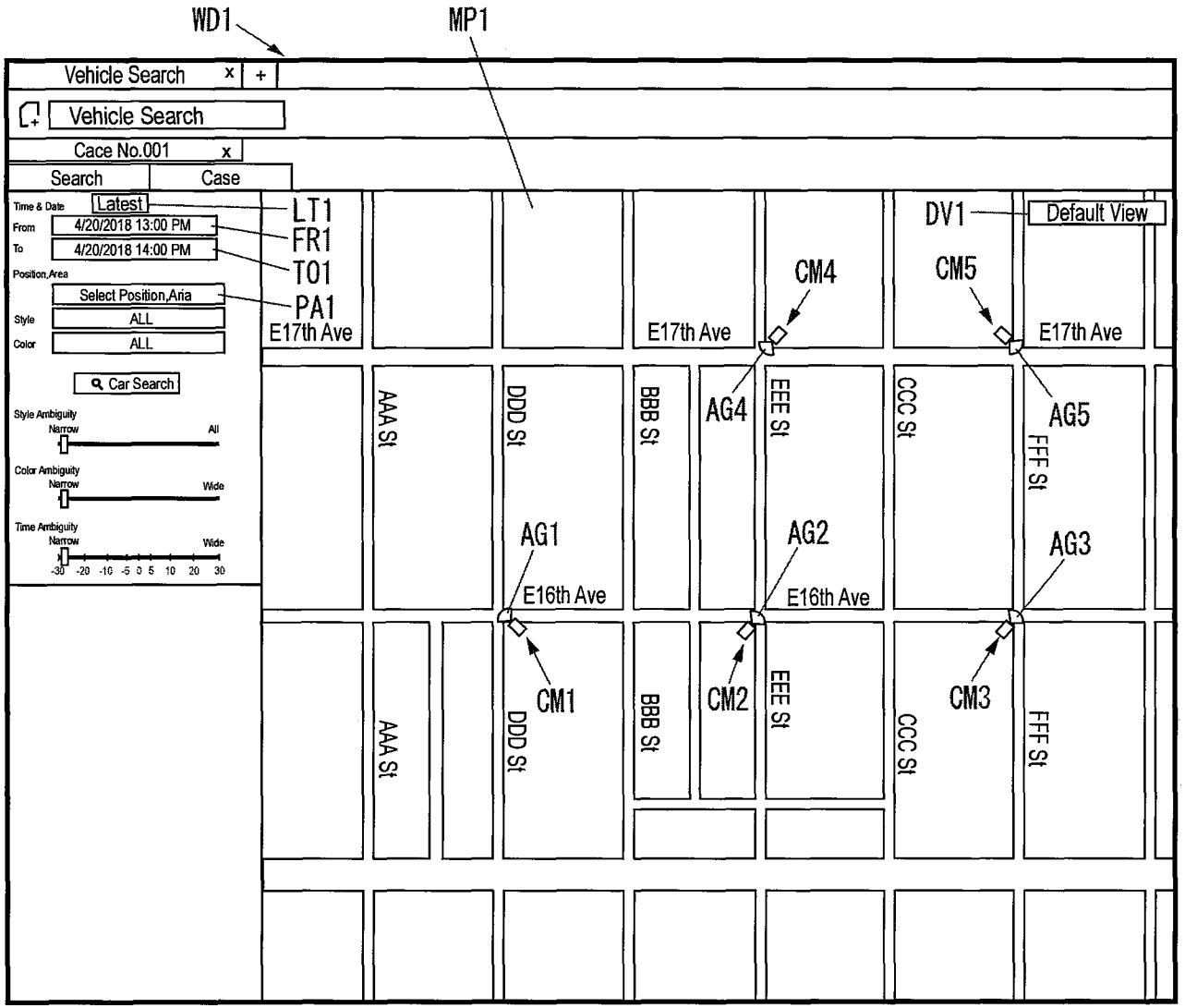
FIG. 8 is a diagram illustrating an example of a vehicle search screen.
Figure 9:
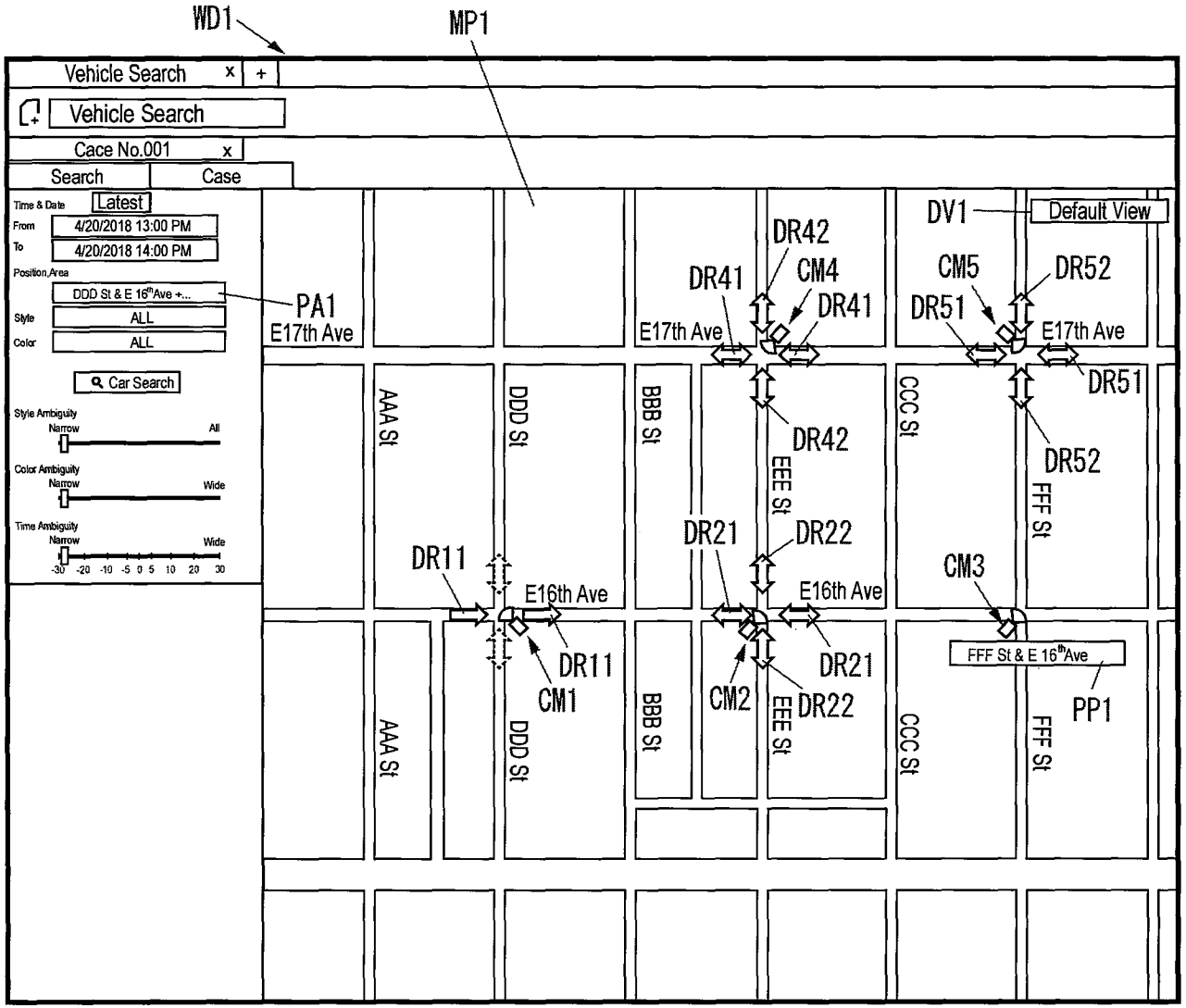
FIG. 9 is an explanatory view illustrating a setting example of flow-in/flow-out direction of a vehicle with respect to an intersection.
Figure 10:
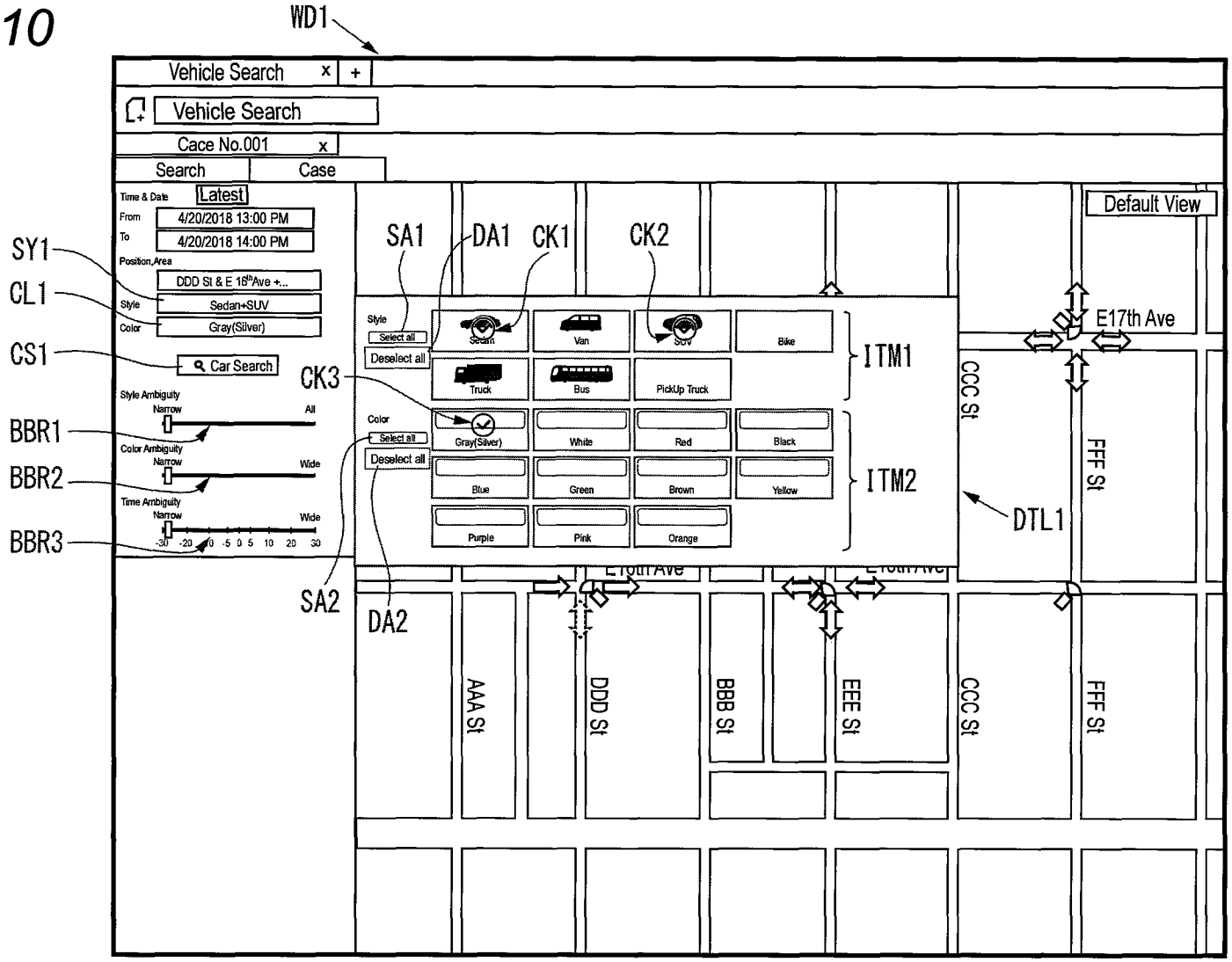
FIG. 10 is an explanatory view illustrating a setting example of a car style and car color of the vehicle.

FIG. 8 is a diagram illustrating an example of a vehicle search screen WD1. FIG. 9 is an explanatory view illustrating a setting example of a flow-in/flow-out direction of a getaway vehicle with respect to an intersection. FIG. 10 is an explanatory view illustrating a setting example of the car style and the car color of the getaway vehicle. The processor 92 displays the vehicle search screen WD1 on the display 94 by a predetermined user operation in the vehicle detection application. The vehicle search screen WD1 is constituted such that both a road map MP1 corresponding to the information of the road map recorded in the recording unit 96 of the client terminal 90 and input fields of a plurality of search conditions specified by a search tab TB1 are displayed side by side. In the following description, the vehicle detection application is executed by the processor 92 and communicates with the vehicle search server 50 or the video recorder 70 during its execution.

Icons of cameras CM1, CM2, CM3, CM4, and CM5 are arranged on the road map MP1 so as to indicate the positions of intersection at which the respective corresponding cameras are installed. Even when one or more cameras are installed at a corresponding intersection, one camera icon is representatively shown. When vehicle information is searched by the vehicle search server 50, captured images of one or more cameras installed at an intersection in a place designated by a user are to be searched. As a result, a user can visually determine the location of the intersection at which the camera is installed. The internal configurations of the cameras CM1 to CM5 are the same as those of the cameras 10, 10*a*, . . . illustrated in FIG. 2. As described above, when the camera is installed at the intersection, only one camera is installed. Further, as described with reference to FIGS. 3 to 5, each of the cameras CM1 to CM5 can capture images with a plurality of imaging view angles using a plurality of imaging portions.

For example, in FIG. 8, the icon of the camera CM1 is arranged such that an imaging view angle AG1 (that is, northwest direction) becomes the center. In addition, the icon of the camera CM2 is arranged such that an imaging view angle AG2 (that is, northeast direction) becomes the center. The icon of the camera CM3 is arranged such that an imaging view angle AG3 (that is, northeast direction) becomes the center. The icon of the camera CM4 is arranged such that an imaging view angle AG4 (that is, southwest direction) becomes the center. Also, the icon of the camera CM5 is arranged such that an imaging view angle AG5 (that is, southeast direction) becomes the center.

Input fields of a plurality of search conditions specified by the search tab TB1 include, for example, a "Latest" icon LT1, a date and time start input field FR1, a date and time end input field TO1, a position area input field PA1, a car style input field SY1, a car color input field CL1, a search icon CS1, a car style ambiguity search bar BBR1, a car color ambiguity search bar BBR2, and a time ambiguity search bar BBR3.

The "Latest" icon LT1 is an icon for setting the search date and time to the latest date and time. When the "Latest" icon LT1 is pressed by a user operation during investigation, the processor 92 sets the latest date and time (for example, a 10 minute-period before the date and time at the time of being pressed) as a search condition (for example, a period).

During investigation, in order for the vehicle search server 50 to search a vehicle (hereinafter, referred to as an "getaway vehicle") on which a person such as a suspect who caused an incident or the like rides, the date and time start input field FR1 is input by a user's operation as the date and time to be a start (origin) of the existence of the getaway vehicle which is a target of the search. In the date and time start input field FR1, for example, the occurrence date and time of an incident or the like or the date and time slightly before the occurrence date and time are input. In FIGS. 8 to 10, an example in which "1:00 p.m. (13:00 p.m.) on Apr. 20, 2018" is input to the date and time start input field FR1 is illustrated. When the date and time are input by a user's operation, the processor 92 sets the date and time input to the date and time start input field FR1 as a search condition (for example, start date and time).

During the investigation, to make the vehicle search server 50 search for the getaway vehicle, the date and time end input field TO1 is input by a user's operation as the date and time at which the existence of the getaway vehicle which is the target of the search is terminated. The end date and time of a search period of the getaway vehicle is input to the date and time end input field TO1. In FIGS. 8 to 10, an example in which "2:00 p.m. (14:00) on Apr. 20, 2018" is input to the date and time end input field TO1 is illustrated. When the date and time are input by a user's operation, the processor 92 sets the date and time input to the date and time end input field TO1 as a search condition (for example, end date and time).

When the processor 92 detects pressing of the date and time start input field FR1 or the date and time end input field TO1 by a user's operation, the processor 92 displays a detailed pane screen (not illustrated) including a calendar (not illustrated) which correspond to each of the date and time start input field FR1 and the date and time end input field TO1 and a pull down list for selecting the time for starting or ending. Further, when the processor 92 detects pressing (clicking) of a predetermined icon (not illustrated) by a user's operation, the processor 92 may display a detailed pane screen (not illustrated) including a calendar (not illustrated) which correspond to each of the date and time start input field FR1 and the date and time end input field TO1 and a pull-down list for selecting the time for starting or ending. As a result, a user is prompted to select the date and time by the client terminal 90. When the date information on which the data of the captured image of the camera is recorded is acquired from the vehicle search server 50, the processor 92 may selectably display only the date corresponding to the date information. The processor 92 can accept other operations only when it is detected that the detailed pane screen (not illustrated) is closed by a user's operation.

During the investigation, to make the vehicle search server 50 search for the getaway vehicle, the position area input field PA1 is input by a user's operation as a position (in other words, the intersection where the camera is installed) where the getaway vehicle which is the target of the search passed. When, for example, the icon of the camera indicated on the road map MP1 is specified by a user's operation, it is displayed in the position area input field PM. In FIGS. 8 to 10, an example in which "DDD St. & E16th Ave+EEE St. & E16th Ave+EEE St. & E17th Ave+FFF St. & E17th Ave" is input to the position area input field PA1 is illustrated. When a location is input by a user's operation, the processor 92 sets the location (that is, position information of the location) input to the position area input field PA1 as a search condition (for example, a location). The processor 92 can accept up to four inputs in the position area input field PA1 and the processor 92 may display a pop-up error message when, for example, an input exceeding four points is accepted.

As illustrated in FIG. 9, the processor 92 can set at least one of the flow-in direction and the flow-out direction of the getaway vehicle to the intersection as a search condition by a predetermined operation on the icon of the camera designated by a user's operation. In FIG. 9, an arrow of a solid line indicates that selection is in progress and an arrow of a broken line indicates a non-selection state. For example, at the intersection of the camera CM1, a direction DR11 indicating one direction from the west to the east is set as a flow-in direction and a flow-out direction. At the intersection of the camera CM2, a direction DR21 indicating bi-direction from the west to the east and from the east to the west and a direction DR22 indicating bi-direction from the south to the north and from the north to the south are respectively set as the flow-in direction and the flow-out direction. At the intersection of the camera CM4, a direction DR41 indicating bi-direction from the west to the east and from the east to the west and a direction DR42 indicating bi-direction from the south to the north and from the north to the south are respectively set as the flow-in direction and the flow-out direction. At the intersection of the camera CM5, a direction DR51 indicating bi-direction from the west to the east and from the east to the west and a direction DR52 indicating bi-direction from the south to the north and from the north to the south are respectively set as the flow-in direction and the flow-out direction.

As illustrated in FIG. 9, when the mouse over on the icon of the camera (for example, camera CM3) by a user's operation is detected, the processor 92 may display the place name of the intersection corresponding to the camera CM3 by a pop-up display PP1.

Also, the road map MP1 in the vehicle search screen WD1 is appropriately slid by a user's operation and displayed by the processor 92. Here, when a default view icon DV1 is pressed by a user's operation, the processor 92 switches the display of the current road map MP1 to the road map MP1 of a predetermined initial state and displays it.

When pressing of the car style input field SY1 or the car color input field CL1 by a user's operation is detected, the processor 92 displays a vehicle style and car color selection screen DTL1 of the getaway vehicle in a state where the vehicle style and car color selection screen DTL1 is superimposed on the road map MP1 of the vehicle search screen WD1.

During the investigation, to make the vehicle search server 50 search for the getaway vehicle, the car style input field SY1 is input as a car style (that is, the shape of the body of the getaway vehicle) of the getaway vehicle which is a target of the search by a user's operation from a plurality of selection items ITM1. Specifically, the selection items ITM1 of the car style include a sedan, a wagon (Van), a sport utility vehicle (SUV), a bike, a truck, a bus, and a pickup truck. At least one of them is selected by a user's operation and input. In FIG. 10, for example, selection icons CK1 and CK2 indicating that a sedan and a sport utility vehicle are selected are illustrated. When all of them are selected, an all selection icon SA1 is pressed by a user's operation. When all the selections are canceled, an all cancel icon DA1 is pressed by a user's operation.

During the investigation, to make the vehicle search server 50 search for the getaway vehicle, the car color input field CL1 is input by a user's operation as the car color (that is, the color of the body of the getaway vehicle) of the getaway vehicle which is a target of the search. Specifically, selection items ITM2 of the car color include gray/silver, white, red, black, blue, green, brown, yellow, purple, pink, and orange. At least one of them is selected and input by a user's operation. In FIG. 10, for example, a selection icon CK3 indicating that gray/silver is selected is illustrated. When all of them are selected, an all selection icon SA2 is pressed by a user's operation. When all the selections are canceled, an all cancel icon DA2 is pressed by a user's operation.

The search icon CS1 is displayed by the processor 92 so that it can be pressed when all the various search conditions input by the user's operation are properly input. When the search icon CS1 is pressed by a user's operation, the processor 92 detects the pressing, generates a vehicle information request including various input search conditions, and sends it to the vehicle search server 50 via the communication unit 93. The processor 92 receives and acquires the search result of the vehicle search server 50 based on the vehicle information request via the communication unit 93.

The car style ambiguity search bar BBR1 is a slide bar which can adjust the car-style search accuracy between the search with narrow accuracy and the search with accuracy including all car styles by a user's operation. When it is adjusted to the narrow side, the processor 92 sets the same car style as that of the car style input field SY1 as the search condition (for example, car style). On the other hand, when it is adjusted to the all side, the processor 92 sets the search condition (for example, car style) including all vehicle styles of the selection items ITM1, not limited to the car style input to the car style input field SY1.

The car color ambiguity search bar BBR2 is a slide bar which can adjust the car-color search accuracy between the search with narrow accuracy and the search with wide accuracy by a user's operation. When it is adjusted to the narrow side, the processor 92 sets the same car color as that of the car color input field CL1 as the search condition (for example, car color). On the other hands, when it is adjusted to the wide side, the processor 92 sets the search condition (for example, car color) broadly including car colors close to or similar to the car color input to the car color input field CL1.

The time ambiguity search bar BBR3 is a slide bar which can adjust the time within the range of, for example, 30 minutes ahead or behind (that is, −30, −20, −10, −5, 0, +5, +10, +20, +30 minutes), as the search accuracy of the start time and the end time of the date and time by a user's operation. When the bars are separately slid to any position between the −30 minute side and the +30 minute side by a user's operation with respect to each of a date and time start input field FR1 and the date and time end input field TO1, the processor 92 sets the search condition (for example, date and time) in a state where the date and time are adjusted according to the position of the adjustment bar of the time ambiguity search bar BBR3 from the respective times inputted to the date and time start input field FM1 and the date and time end input field TO1.

Figure 11:
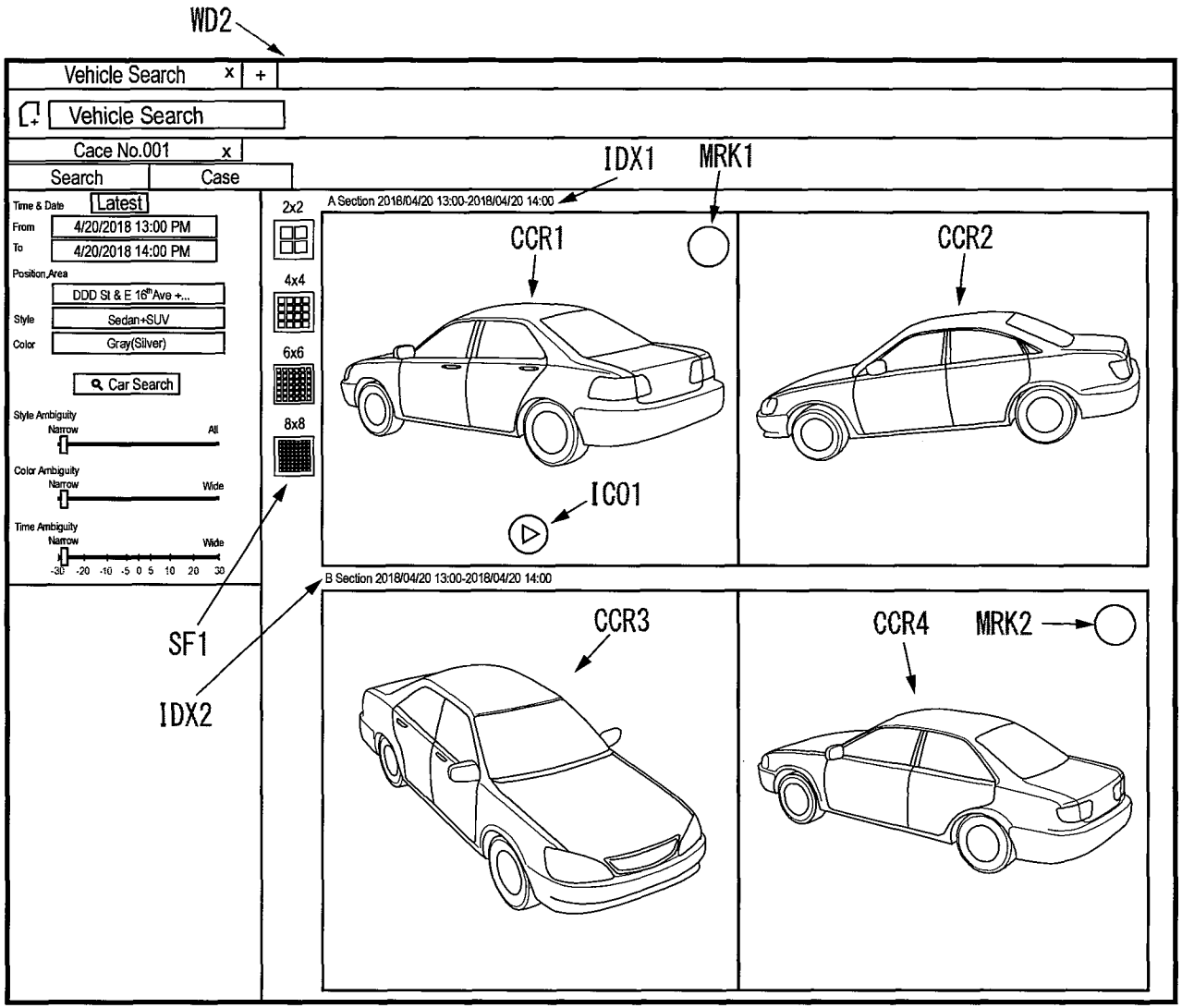
FIG. 11 is a diagram illustrating an example of a search result screen of a vehicle candidate.
Figure 12:
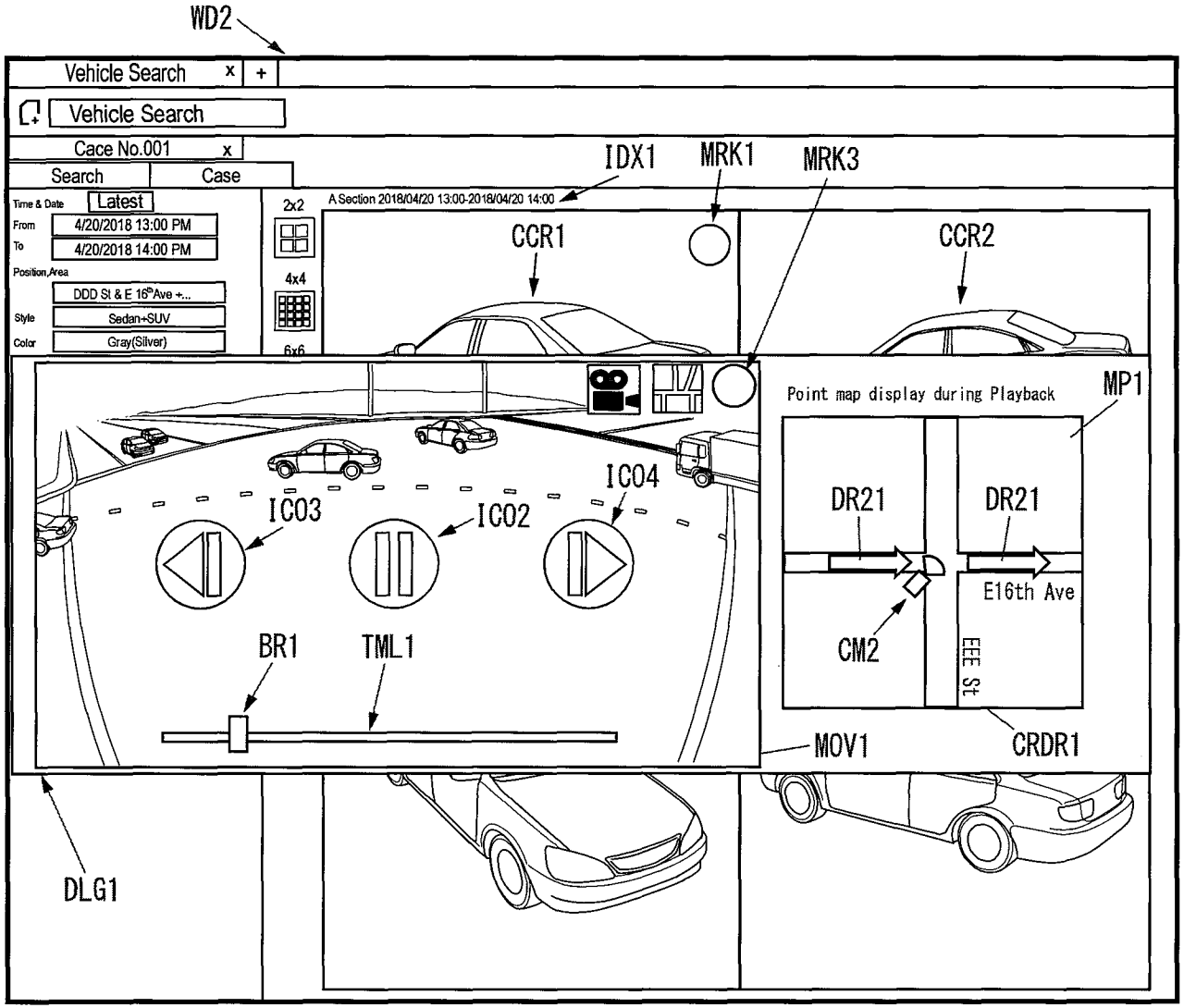
FIG. 12 is a diagram illustrating an example of an image reproduction dialog which illustrates a reproduction screen of an image when a vehicle candidate selected by a user's operation passes through an intersection and the flow-in/flow-out direction of the vehicle candidate with respect to the intersection in association with each other.
Figure 13:
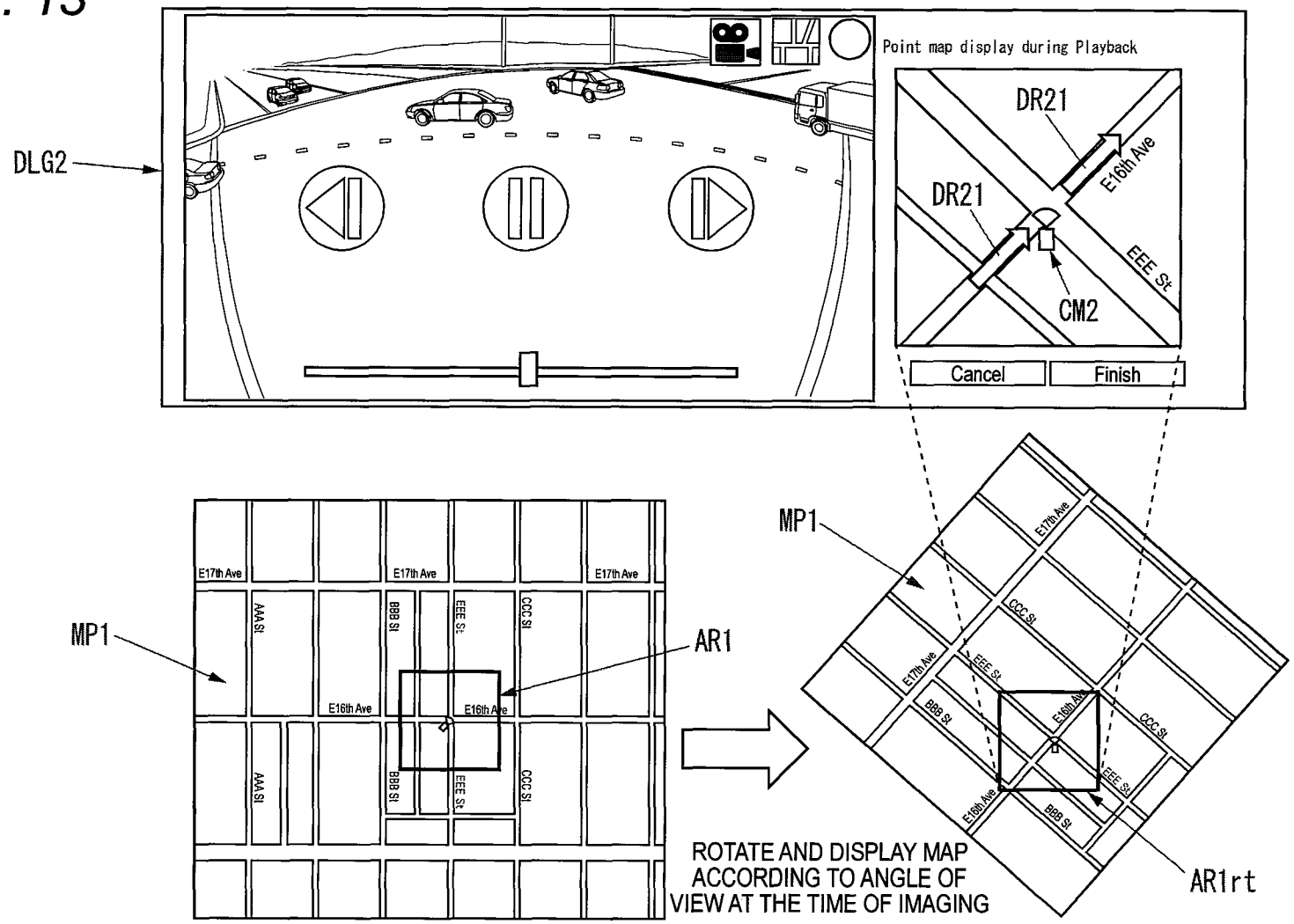
FIG. 13 is a diagram illustrating a display modification example of a map displayed on the image reproduction dialog.
Figure 14:
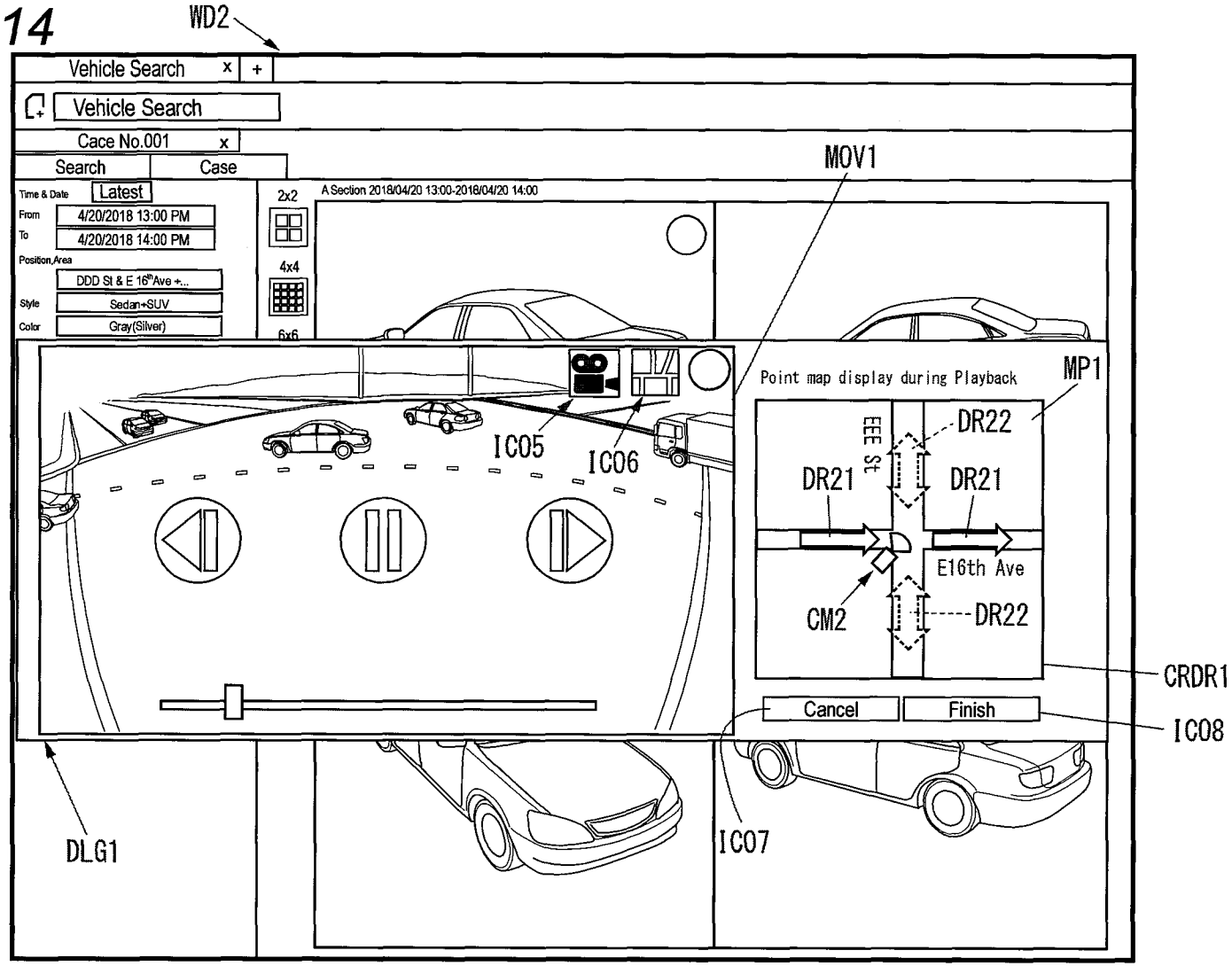
FIG. 14 is an explanatory view illustrating various operation examples for the image reproduction dialog.
Figure 15:
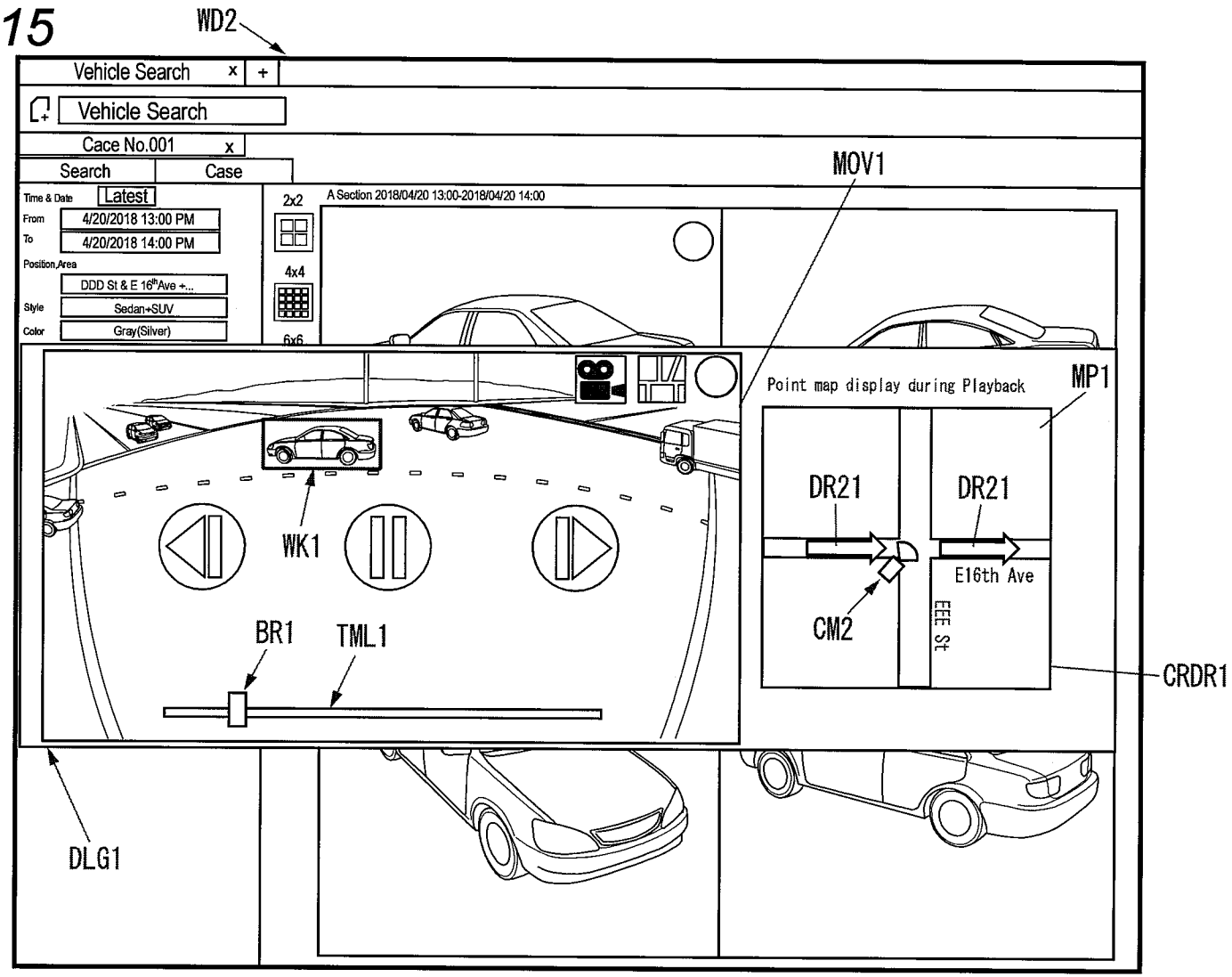
FIG. 15 is an explanatory view illustrating an example in which an attention frame is displayed following the movement of the vehicle candidate in the reproduction screen of the image reproduction dialog.
Figure 16:
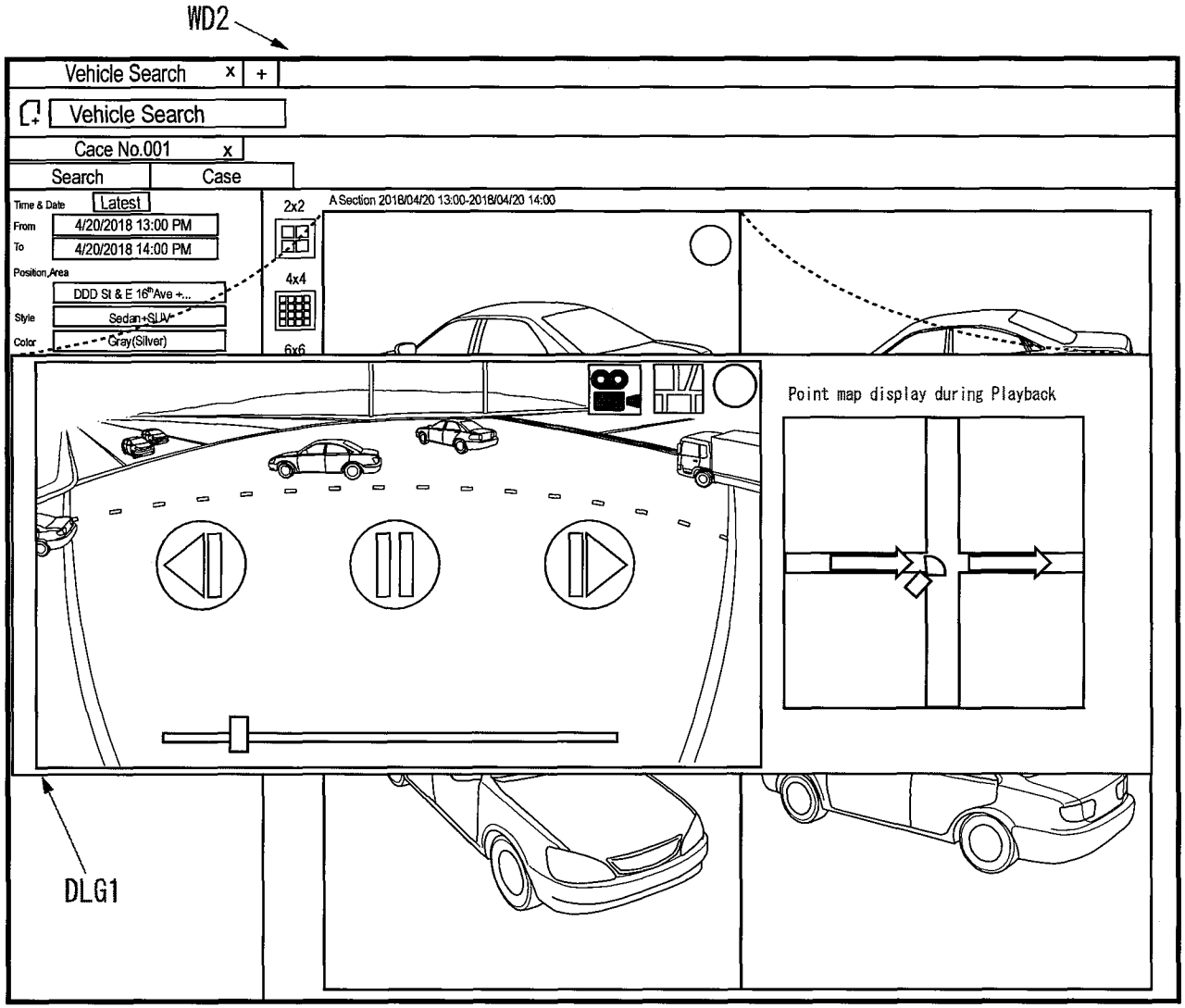
FIG. 16 is an explanatory view of a screen transition example when the image reproduction dialog is closed by a user's operation.

FIG. 11 is a diagram illustrating an example of a search result screen WD2 of a vehicle candidate. FIG. 12 is a diagram illustrating an example of an image reproduction dialog DLG1 which illustrates a reproduction screen of an image when a vehicle candidate selected by a user's operation passes through an intersection and flow-in/flow-out directions of the vehicle candidate with respect to the intersection in association with each other. FIG. 13 is a diagram illustrating a display modification example of a map displayed on the image reproduction dialog DLG1. FIG. 14 is an explanatory view illustrating various operation examples for the image reproduction dialog DLG1. FIG. 15 is an explanatory view illustrating an example in which an attention frame WK1 is displayed following the movement of the vehicle candidate in the reproduction screen of the image reproduction dialog DLG1. FIG. 16 is an explanatory view of a screen transition example when the image reproduction dialog DLG1 is closed by a user's operation.

In the vehicle detection application, when the data of a vehicle search result is acquired from the vehicle search server 50 by s user's operation of pressing the search icon CS1 in the vehicle search screen WD1, the search result screen WD2 of the vehicle candidates (that is, getaway vehicle candidates) is displayed on the display 94. The search result screen WD2 has a configuration in which both the input fields of a plurality of search conditions specified by the search tab TB1 and the lists of a search result of vehicle candidates searched by the vehicle search server 50 are displayed side by side.

In FIG. 11, based on the vehicle information request including the search conditions described with reference to FIGS. 8 to 10, the search result made by the vehicle search server 50 is illustrated as a list with indices IDX1 and IDX2 including the date and time and the location of the search conditions. Specifically, the search result screen WD2 is displayed on the display 94 of the client terminal 90. In FIG. 11, for example, vehicle thumbnail images CCR1, CCR2, CCR3, and CCR4 of four (=2*2, *: multiplier operator) vehicle candidates (that is, candidates of the getaway vehicle) are displayed in one screen. When any display number change icon SF1 is pressed by a user's operation, the processor 92 displays the vehicle thumbnail images corresponding to the search result in a state where the display number of vehicle thumbnail images is changed to the display number corresponding to the pressed display number change icon SF1. The display number change icon SF1 is illustrated as being selectable from 2*2, 4*4, 6*6, and 8*8, for example.

The indices IDX1 and IDX2 are used, for example, to display search results (vehicle thumbnail images) by dividing the search results at every location and at every predetermined time (for example, 10 minutes). Therefore, vehicles in the vehicle thumbnail images CCR1 and CCR2 corresponding to the index IDX1 are vehicles which are searched at the same location (for example, A section) and in the same time period from the start date and time to the end date and time of the search condition. Similarly, vehicles in the vehicle thumbnail images CCR3 and CCR4 corresponding to the index IDX2 are vehicles which are searched at the same location (for example, B section) and in the same time period from the start date and time to the end date and time of the search condition.

Further, when a user who viewed the vehicle thumbnail images displayed on the search result screen WD2 considers that the vehicle in the image is a suspect vehicle having the possibility of the getaway vehicle, the processor 92 displays suspect candidate marks MRK1 and MRK2 near the corresponding vehicle thumbnail images by a user's operation. In this case, the processor 92 temporarily holds information indicating that the suspect candidate mark is assigned in association with the selected vehicle thumbnail image. In the example of FIG. 11, it is indicated that suspect candidate marks MRK1 and MRK2 are respectively given to the two vehicles in the vehicle thumbnail images CCR1 and CCR4.

As illustrated in FIG. 11, when the mouse over in the vehicle thumbnail image (for example, vehicle thumbnail image CCR1) by a user's operation is detected, the processor 92 displays a reproduction icon ICO1 of the captured image in which the vehicle corresponding to the vehicle thumbnail image CCR1 is captured.

FIG. 12 illustrates the image reproduction dialog DLG1 displayed by the processor 92 when it is detected by the processor 92 that the reproduction icon ICO1 is pressed by a user's operation. The processor 92 displays the image reproduction dialog DLG1 on the display areas of, for example, the vehicle thumbnail images CCR1 to CCR4 in a superimposed manner. The image reproduction dialog DLG1 has a configuration in which a reproduction screen MOV1 and a passing direction screen CRDR1 are arranged in association with each other. The reproduction screen MOV1 is a reproduction screen of a captured image where the vehicle of the vehicle thumbnail image CCR1 corresponding to the reproduction icon ICO1 is captured by a camera installed at a location (for example, intersection) included in the index IDX1. The passing direction screen CRDR1 is a screen on which passing directions (specifically, the direction DR21 indicating the flow-in direction and the direction DR21 indicating the flow-out direction) at the time of passing through the intersection is superimposed on the road map MP1 of the vehicle corresponding to the captured image reproduced by the reproduction screen MOV1. The name of the intersection may also be displayed at a predetermined position outside the road map MP1. In FIG. 12, the captured image when the vehicle passes through the intersection of "EEE St. & E16th Ave" and the passing direction thereof are illustrated in association with each other.

The processor 92 can display a pause icon ICO2, a frame return icon ICO3, a frame advance icon ICO4, an adjustment bar BR1, and a reproduction time board TML1 by a predetermined user's operation on the reproduction screen MOV1. When the pause icon ICO2 is pressed by a user's operation during reproduction of the captured image, the processor 92 is instructed to execute a temporary stop. When the frame return icon ICO3 is pressed by a user's operation during reproduction of the captured image, the processor 92 is instructed to execute frame return. When the frame advance icon ICO4 is pressed by a user's operation during reproduction of the captured image, the processor 92 is instructed to execute frame advance. When the adjustment bar BR1 is appropriately slid according to a user's operation with respect to the reproduction time board TML1 indicating the entire reproduction time of the captured image, the processor 92 switches and reproduces the reproduction time of the captured image according to the slide.

Further, when a user who viewed the captured images reproduced on the image reproduction dialog DLG1 considers that the vehicle in the image is a suspect vehicle having the possibility of the getaway vehicle, the processor 92 displays a suspect candidate mark MRK3 in the corresponding image reproduction dialog DLG1 by a user's operation. In this case, the processor 92 temporarily holds information indicating that the suspect candidate mark is given in association with the vehicle thumbnail image of the image reproduction dialog DLG1.

The processor 92 can change and display a direction of the passing direction screen CRDR2 indicating the passing direction when the vehicle passes through the intersection by a predetermined user's operation on the image reproduction dialog DLG1 such that the direction of the passing direction screen CRDR2 coincides with the imaging angle of view of the camera CM2 (see FIG. 13). In the image reproduction dialog DLG2 illustrated in FIG. 13, unlike the image reproduction dialog DLG1 illustrated in FIG. 12, it is displayed in a state where the direction of the passing direction screen CRDR2 is changed (for example, rotated) so as to coincide with the imaging angle of view of the camera CM2.

More specifically, the processor 92 rotates a map portion AR1 of the data of the road map MP1 which is displayed in the passing direction screen CRDR1 so as to coincide with the imaging angle of view of the camera CM2, and then the processor 92 places and displays a rotated map portion AR1*rt* in the passing direction screen CRDR2. As a result, it becomes easier for a user to recognize by visually correlating the reproduction screen MOV1 of the captured image and the passing direction at the time of passing through the intersection.

As illustrated in FIG. 14, the processor 92 can display a recorded image confirmation icon ICO5 and a passing direction correction icon ICO6 on the reproduction screen MOV1 of the image reproduction dialog DLG1. When the passing direction correction icon ICO6 is pressed, the processor 92 is instructed to correct the pass direction (for example, direction DR21) displayed on passing direction screen CRDR2 by a user's operation. In the passing direction screen CRDR1 of FIG. 14, a passing direction (for example, flow-in direction) preceding the correction is corrected from the direction DR21 to the direction DR22 by a user's operation and a passing direction (for example, flow-out direction) preceding the correction is corrected from the direction DR21 to the direction DR22.

When any one of a cancel icon ICO7 and a completion icon ICO8 is pressed by a user's operation after the correction is performed, the processor 92 executes a process corresponding to the pressed icon. Specifically, when it is detected that the cancel icon ICO7 is pressed, the processor 92 cancels the correction by a user's operation. On the other hand, when it is detected that the completion icon ICO8 is pressed, the processor 92 reflects and saves the correction by a user's operation. When it is detected that the passing direction correction icon ICO6 is pressed, the processor 92 may not accept the input of a user's operation unrelated to the correction of the passing direction until it is detected that any one of the cancel icon ICO7 and the completion icon ICO8 is pressed.

In addition, when it is detected that the completion icon ICO8 is pressed, the processor 92 executes an error check so as not to correspond to a predetermined condition and, when there is an error as an execution result, a message to that effect may be displayed on the display 94. The predetermined condition means that, for example, the flow-in direction or the flow-out direction is two directions, the flow-in direction or the flow-out direction is not set, or the like.

When the recorded image confirmation icon ICO5 is pressed at a time other than during the correction of the passing direction, the processor 92 is instructed to execute an acquisition request of data of a captured image having a reproduction time width longer than that of the captured image which can be reproduced in the reproduction screen MOV1. In accordance with the instruction, the processor 92 requests data of the corresponding captured image to the video recorder 70 and receives and acquires the data of the captured image sent from the video recorder 70 via the communication unit 93. The processor 92 reproduces the data of the captured image sent from the video recorder 70 by displaying another image reproduction screen (not illustrated) different from the search result screen WD2.

The reproduction time width of the captured image reproduced in the reproduction screen MOV1 of the image reproduction dialog DLG1 is a certain period of time from the entry (that is, flowing-in) of a vehicle to the corresponding intersection to the exit (that is, flowing-out) of the vehicle. On the other hand, the video recorder 70 stores the data of captured images while each of the cameras 10, 10*a*, . . . captures an image. Therefore, the reproduction time width of the captured image which is captured at the same date and time at the same location and stored in the video recorder 70 is clearly longer than that of the captured image reproduced on the reproduction screen MOV1. Therefore, a user can view an image of the time other than the reproduction time in the reproduction screen MOV1 of the image reproduction dialog DLG1 or can view the captured image in another image reproduction screen (see above) in a state where zoom processing such as enlargement or reduction is performed on the image.

While another image reproduction screen is displayed, the processor 92 can accept input of another user's operation to the image reproduction dialog DLG1, thereby improving the convenience of user operation. This is because, for example, while the passing direction is corrected, the processor 92 cannot accept input of another user's operation on the image reproduction dialog DLG1. Further, when a user's operation for closing the image reproduction dialog DLG1 is accepted, the processor 92 may close other image reproduction screens (see above) at the same time.

As illustrated in FIG. 15, when a captured image is reproduced in the reproduction screen MOV1 of the image reproduction dialog DLG1, the processor 92 may display the attention frame WK1 in a predetermined shape (for example, rectangular shape) which is superimposed on a vehicle only when the vehicle is paused by pressing the pause icon ICO2 or while the vehicle appears during the reproduction. This allows a user to visually and intuitively grasp the existence of a targeted vehicle in the reproduction screen MOV1, and thus the convenience of the investigation can be improved. Further, the processor 92 may display the attention frame WK1 following the movement of the vehicle when frame-returning or frame-advancing of the captured image is performed by pressing the frame return icon ICO3 or the frame advance icon ICO4. As a result, a user can easily determine the moving direction of the target vehicle in the reproduction screen MOV1 by frame-returning or frame-advancing.

As illustrated in FIG. 16, when a user's operation for closing the image reproduction dialog DLG1 is accepted, the processor 92 executes an animation such that the image reproduction dialog DLG1 is absorbed in the vehicle thumbnail image (for example, vehicle thumbnail image CCR1) corresponding to the image reproduction dialog DLG1 and hides the image reproduction dialog DLG1. Therefore, a user can enjoy watching the state that the image reproduction dialog DLG1 is closed so as to be absorbed so that it can be intuitively grasped whether the image being reproduced in the image reproduction dialog DLG1 to be not necessary corresponds to any vehicle thumbnail image CCR1.

Figure 17:
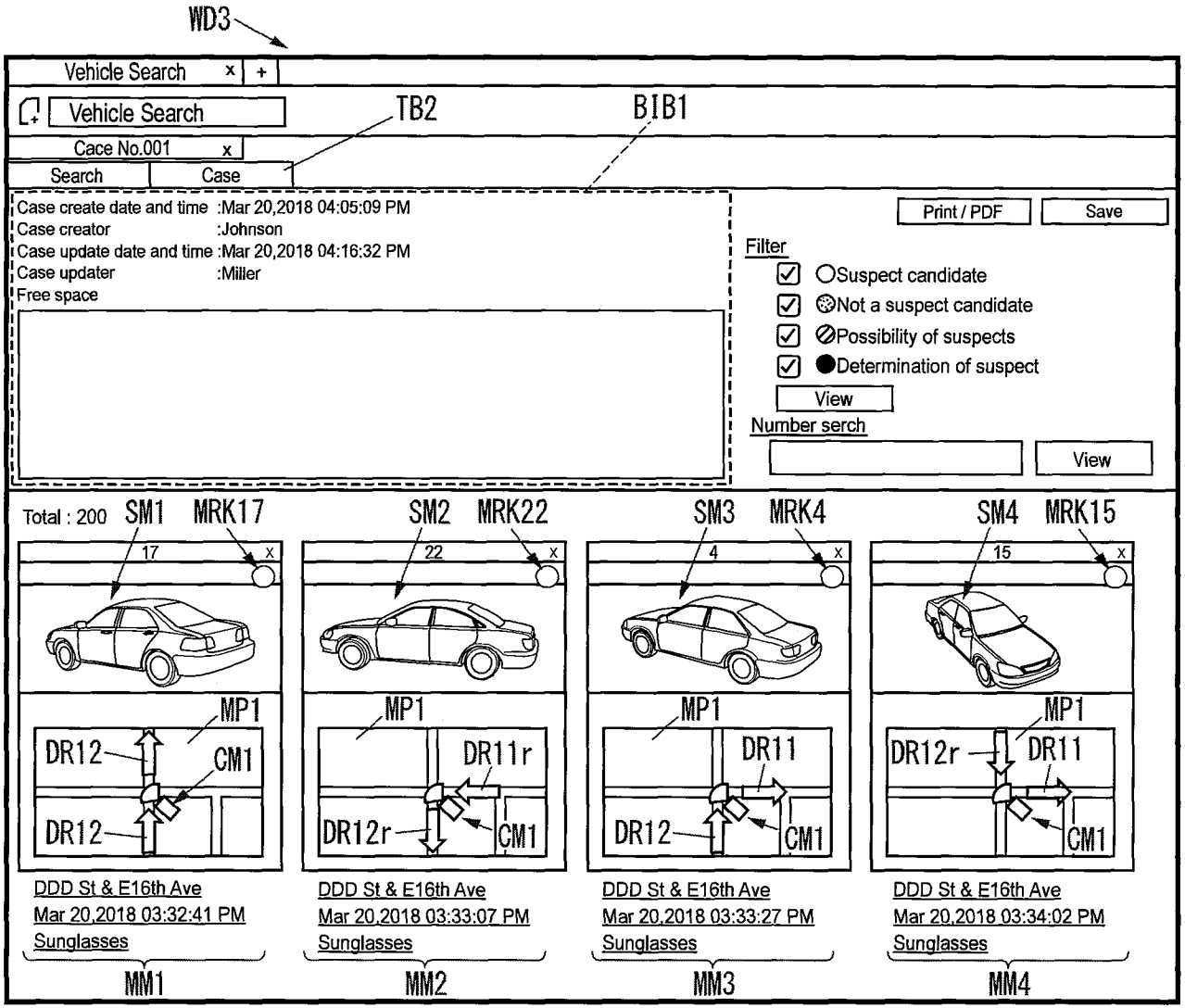
FIG. 17 is a diagram illustrating an example of a case screen.
Figure 18:
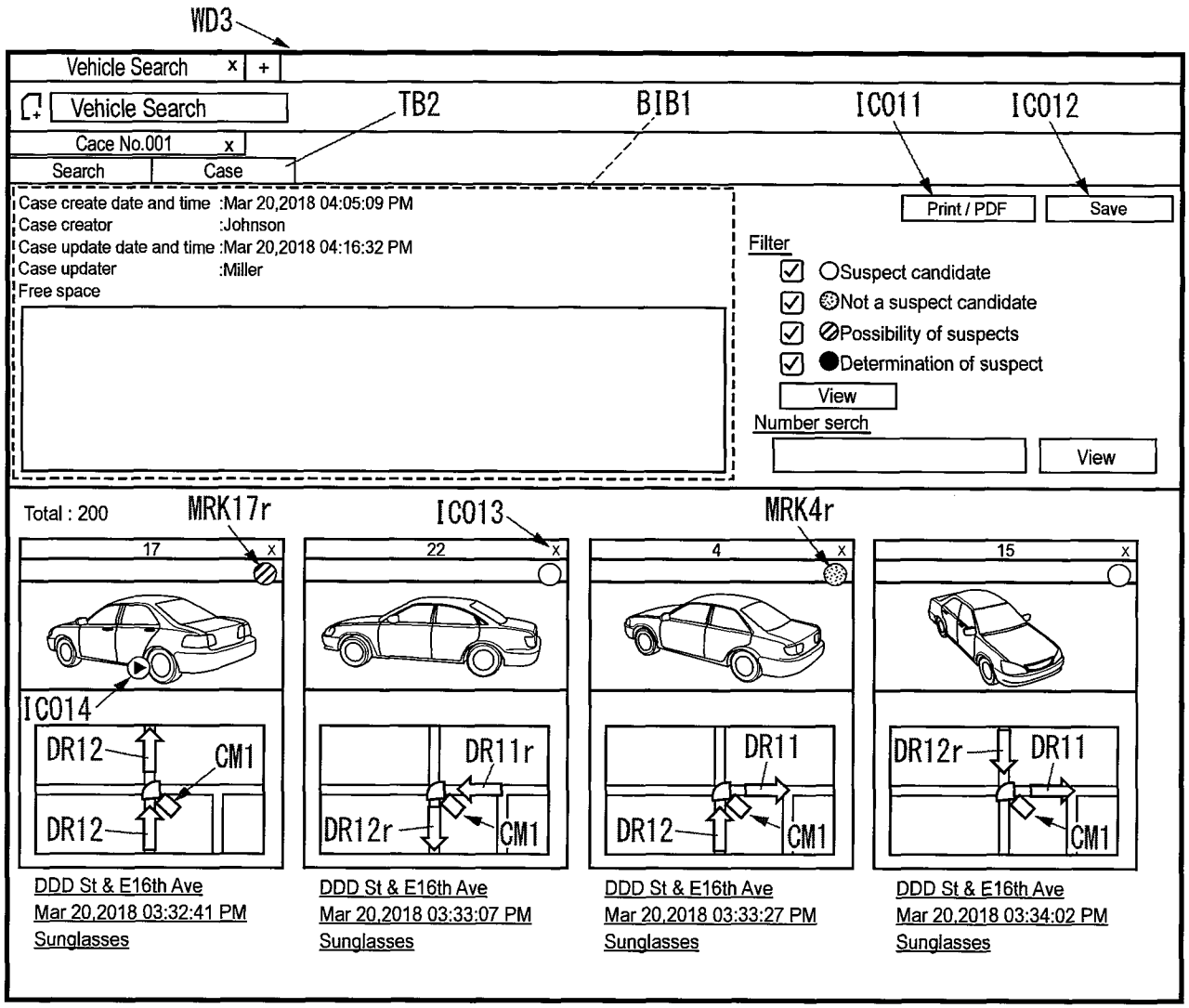
FIG. 18 is an explanatory view illustrating an example of rank change of a suspect candidate mark.
Figure 19:
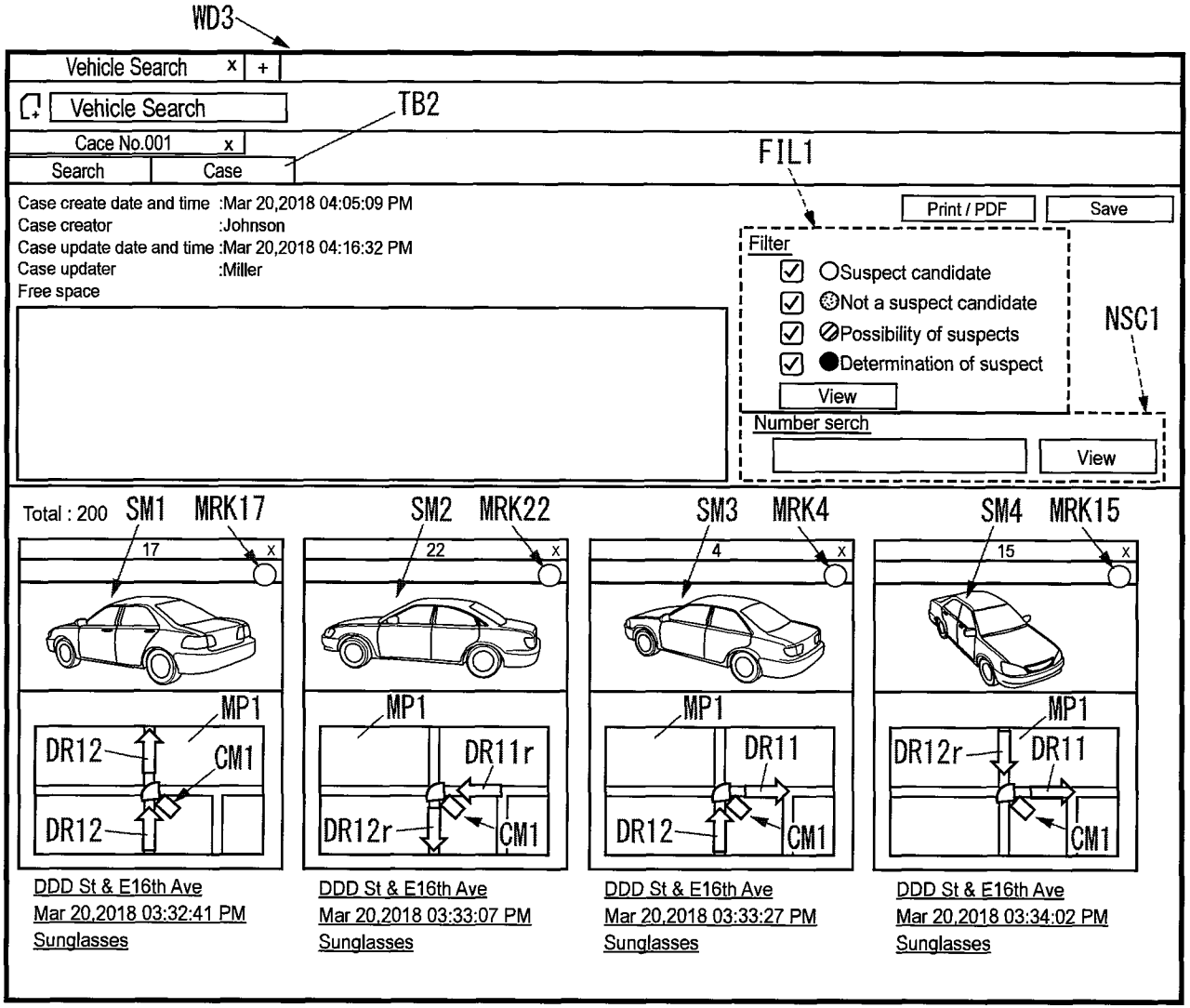
FIG. 19 is an explanatory view illustrating an example of filtering by the rank of the suspect candidate mark.

FIG. 17 is a diagram illustrating an example of a case screen WD3. FIG. 18 is an explanatory view illustrating an example of rank change of the suspect candidate mark. FIG. 19 is an explanatory view illustrating an example of filtering by the rank of the suspect candidate mark. The case screen WD3 has a configuration in which both various bibliographic information BIB1 related to a specific case and data (hereinafter, referred to as "case data") including a vehicle search result by the vehicle search server 50 corresponding to the case are displayed side by side. The case screen WD3 is displayed by the processor 92 when, for example, a case tab TB2 is pressed by a user's operation. In the case screen WD3, the bibliographic information BIB1 includes the case occurrence date and time (Case create date and time), the Case creator, the Case update date and time, the Case updater, and the Free space.

The case create date and time indicates, for example, the date and time when the case data including a vehicle search result and the like using the search condition of the vehicle search screen WD1 is created and, in the example of FIG. 17, "May 20, 2018, 04:05:09 PM" is illustrated.

The case creator indicates, for example, the name of a police officer who is a user who created the case data and, in the example of FIG. 17, "Johnson" is illustrated.

The Case update date and time indicates, for example, the date and time when the case data once created is updated and "May 20, 2018, 04:16:32 PM" is illustrated in the example of FIG. 17.

The Case updater indicates, for example, the name of a police officer who is a user who updated the content of the case data once created and "Miller" is illustrated in the example of FIG. 17.

In the case screen WD3, a vehicle search result list by the vehicle search server 50 corresponding to a specific case is illustrated with the bibliographic information BIB1 described above. In the example of FIG. 17, the search results of a total of 200 vehicles are obtained and vehicle thumbnail images SM1, SM2, SM3, and SM4 of the first four vehicles are exemplarily illustrated. When there are five or more search results, the processor 92 scrolls and displays the screen according to a user's scroll operation as appropriate. To indicate that there is a possibility that a person such as a suspect may ride on the vehicle, suspect candidate marks MRK17, MRK22, MRK4, and MRK15 with a yellow rank (see below) are respectively given to the vehicles corresponding to the vehicle thumbnail images SM1, SM2, SM3, and SM4 illustrated in FIG. 17 by a user's operation.

In the example of FIG. 17, the vehicle thumbnail image SM1 and the passing directions (specifically, the direction DR12 indicating the flow-in direction and the direction DR12 indicating the flow-out direction) when the vehicle corresponding to the vehicle thumbnail image SM1 passes through the intersection on "DDD ST. & E16th Ave" on which the camera CM1 is arranged on the road map MP1 are displayed in association with each other. Further, the location (for example, an intersection on "DDD ST. & E16th Ave") at which the vehicle corresponding to the vehicle thumbnail image SM1 is detected by analysis of the captured image of the camera CM1, the date and time (for example, "May 20, 2018 03:32:41 PM"), and a memo (for example, "sunglasses") of the creator or updater are displayed as a memorandum MM1. Data input to the memo field can be made by a user's operation to show the features of a suspect and the like.

Similarly, the vehicle thumbnail image SM2 and the passing directions (specifically, the direction DR11*r* indicating the flow-in direction and the direction DR12*r* indicating the flow-out direction) when the vehicle corresponding to the vehicle thumbnail image SM2 passes through the intersection on "DDD ST. & E16th Ave" on which the camera CM1 is arranged on the road map MP1 are displayed in association with each other. Further, the location (for example, an intersection on "DDD ST. & E16th Ave") at which the vehicle corresponding to the vehicle thumbnail image SM2 is detected by analysis of the captured image of the camera CM1, the date and time (for example, "May 20, 2018 03:33:07 PM"), and a memo (for example, "sunglasses") of the creator or updater are displayed as a memorandum MM2.

Similarly, the vehicle thumbnail image SM3 and the passing directions (specifically, the direction DR12 indicating the flow-in direction and the direction DR11 indicating the flow-out direction) when the vehicle corresponding to the vehicle thumbnail image SM3 passes through the intersection on "DDD ST. & E16th Ave" on which the camera CM1 is arranged on the road map MP1 are displayed in association with each other. Further, the location (for example, an intersection on "DDD ST. & E16th Ave") at which the vehicle corresponding to the vehicle thumbnail image SM3 is detected by analysis of the captured image of the camera CM1, the date and time (for example, "May 20, 2018 03:33:27 PM"), and a memo (for example, "sunglasses") of the creator or updater are displayed as a memorandum MM3.

Similarly, the vehicle thumbnail image SM4 and the passing directions (specifically, the direction DR12*r* indicating the flow-in direction and the direction DR11 indicating the flow-out direction) when the vehicle corresponding to the vehicle thumbnail image SM4 passes through the intersection on "DDD ST. & E16th Ave" on which the camera CM1 is arranged on the road map MP1 are displayed in association with each other. Further, the location (for example, an intersection on "DDD ST. & E16th Ave") at which the vehicle corresponding to the vehicle thumbnail image SM4 is detected by analysis of the captured image of the camera CM1, the date and time (for example, "May 20, 2018 03:34:02 PM"), and a memo (for example, "sunglasses") of the creator or updater are displayed as a memorandum MM4.

As illustrated in FIG. 18, when a user who viewed the vehicle thumbnail images displayed on the case screen WD3 examines the possibility that there is a possibility of a getaway vehicle or no possibility, the processor 92 can change and display the rank of the suspect candidate mark given to the corresponding vehicle thumbnail image by a user's operation. In the examples of FIGS. 17 to 19, the rank of the suspect candidate mark of "yellow" indicates that the vehicle is suspicious as a candidate for the getaway vehicle of the suspect. Similarly, the rank of the suspect candidate mark of "white" indicates that the vehicle does not appropriate to a candidate for the getaway vehicle of the suspect. Similarly, the rank of the suspect candidate mark of "red" indicates that the vehicle is more considerably suspicious as a candidate for the getaway vehicle of the suspect than that of the rank of the suspect candidate mark of "yellow". Similarly, the rank of the suspect candidate mark of "black" indicates that the vehicle is definitely suspicious as a candidate for the getaway vehicle of the suspect.

In the example of FIG. 18, it is indicated that, based on a user's operation, the suspect candidate mark of the vehicle of the vehicle thumbnail image SM1 is changed to a suspect candidate mark MRK17*r* having a red rank by the processor 92.

Similarly, it is indicated that, based on a user's operation, the suspect candidate mark of the vehicle of the vehicle thumbnail image SM3 is changed to a suspect candidate mark MRK4*r* having a white rank by the processor 92.

In addition, the processor 92 can display a "Print/PDF" icon ICO11 and a "Save" icon ICO12 on the case screen WD3. When the "Print/PDF" icon ICO11 is pressed, the processor 92 is instructed to send the case date corresponding to the current case tab TB2 to a printer (not illustrated) connected to the client terminal 90 and print out it or to create a case report (see below). When the "Save" icon ICO12 is pressed, the processor 92 is instructed to save the case data corresponding to the current case tab TB2 in the vehicle search server 50.

Further, when it is detected that an X mark ICO13 displayed within the display window frame of the vehicle thumbnail image is pressed by a user's operation, the processor 92 hides the display window frame from the case screen WD3. That is, by a user's operation, the vehicle thumbnail image is deleted from the case data because there is no possibility of the getaway vehicle.

When it is detected that the vehicle thumbnail image is subjected to mouse-over by a user's operation, the processor 92 displays a reproduction icon ICO14 of the captured image of the camera in which the vehicle thumbnail image is captured. Therefore, a user can easily view the captured image when the vehicle which is suspicious among the vehicles of the vehicle thumbnail images displayed on the search result screen WD2 passes through the intersection.

As illustrated in FIG. 19, when it is detected that at least one of the ranks (for example, yellow, white, red, and black) of the suspect candidate marks is selected by a user's operation and a View icon is pressed, the processor 92 can filter out (select) and extract the vehicle thumbnail image to which the corresponding suspect candidate marker is given from the current case data. In FIG. 19, a filtering operation display area FIL1 including a check box of the suspect candidate marker and the View icon is displayed for filtering based on the rank of the suspect candidate marker.

As illustrated in FIG. 19, when it is detected that an individual identification number (for example, the identification number given to the display window of the vehicle thumbnail image) is input and the View icon is pressed, the processor 92 can filter out (select) and extract the corresponding vehicle thumbnail image from the current case data. In FIG. 19, a filtering operation display area NSC1 including an identification number input field and the View icon is displayed for filtering based on the individual identification number.

Next, the operation procedure of the vehicle detection system 100 according to the first embodiment will be described with reference to FIGS. 20, 21, 22, 23, and 24. In FIGS. 20 to 24, the explanation is mainly focused on the operation of the client terminal 90 and the operation of the vehicle search server 50 is complementarily explained as necessary.

Figure 20:
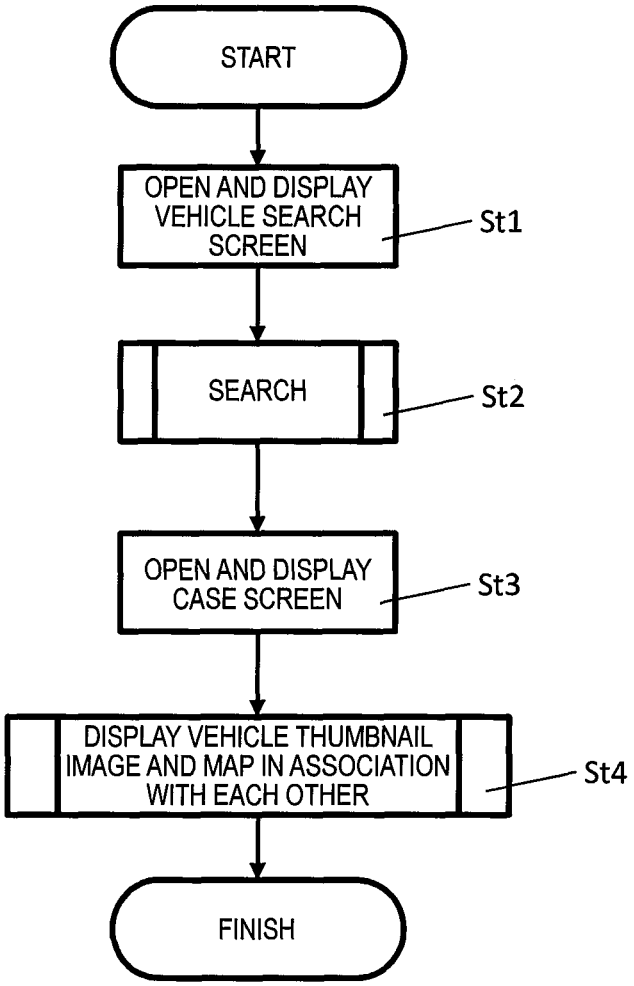
FIG. 20 is a flowchart illustrating an example of an operation procedure of an associative display of a vehicle thumbnail image and a map.
Figure 21:
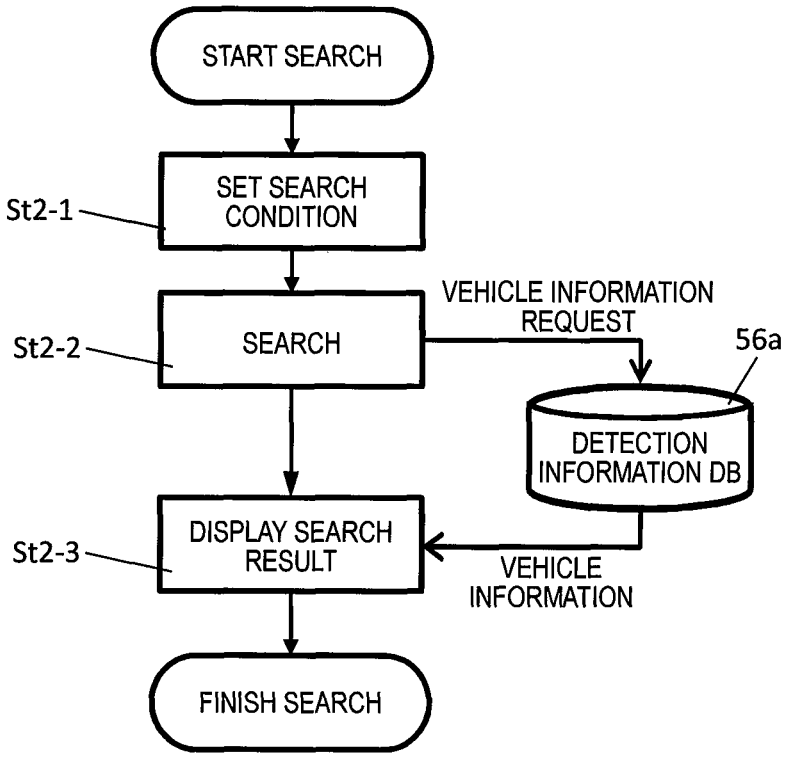
FIG. 21 is a flowchart illustrating an example of a detailed operation procedure of Step St2 in FIG. 20.
Figure 22:
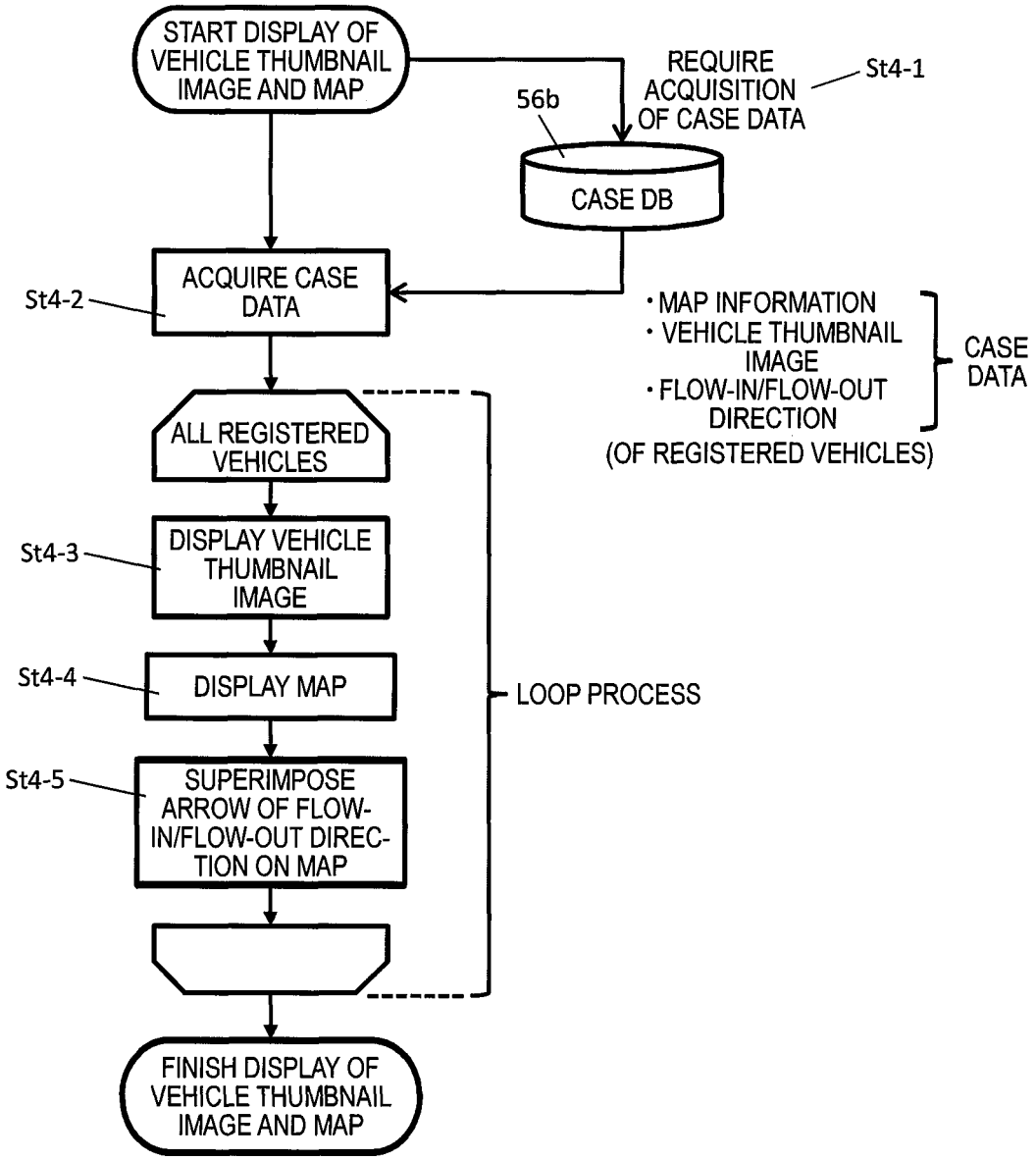
FIG. 22 is a flowchart illustrating an example of a detailed operation procedure of Step St4 in FIG. 20.

FIG. 20 is a flowchart illustrating an example of an operation procedure of an associative display of the vehicle thumbnail image and the map. FIG. 21 is a flowchart illustrating an example of a detailed operation procedure of Step St2 in FIG. 20. FIG. 22 is a flowchart illustrating an example of a detailed operation procedure of Step St4 in FIG. 20.

In FIG. 20, when a user executes an activation operation of the vehicle detection application, the processor 92 of the client terminal 90 activates and executes the vehicle detection application and displays the vehicle search screen WD1 (see FIG. 8, for example) on the display 94 (SU). After Step St1, the processor 92 generates the vehicle information request based on a user's operation for inputting various search conditions to the vehicle search screen WD1 and sends the vehicle information request to the vehicle search server 50 via the communication unit 93 to execute the search (St2).

The processor 92 receives and acquires the data of the vehicle search result obtained by the search of the vehicle search server 50 in Step St2 via the communication unit 93, and then the processor 92 generates and displays the search result screen WD2 (see FIG. 11, for example). The processor 92 sends the data of the search result as case data to the case DB 56*b* of the vehicle search server 50 via the communication unit 93 by a user's operation such that the data of the search result is stored in the case DB 56*b*. As a result, the vehicle search server 50 can store the case data sent from the client terminal 90 in the case DB 56*b*.

Then, the processor 92 accepts the input of a user's operation for displaying the case screen WD3 in the vehicle detection application (St3). After Step St3, the processor 92 acquires the case data stored in the case DB 56*b* of the vehicle search server 50 and generates and displays the case screen WD3 in which the vehicle thumbnail image as the search result of Step St2 and the passing direction on the map when the vehicle corresponding to the vehicle thumbnail image passes through the intersection are associated with each other using the case data (St4).

In FIG. 21, the processor 92 accepts and sets the input of various search conditions (see above) by a user's operation on the vehicle search screen WD1 displayed on the display 94 (St2-1). The processor 92 generates a vehicle information request including the search conditions set in Step St2-1 and sends it to the vehicle search server 50 via the communication unit 93 (St2-2).

Based on the vehicle information request sent from the client terminal 90, the vehicle search unit 53 of the vehicle search server 50 searches the detection information DB 56*a* of the storage unit 56 for vehicles satisfying the search conditions included in the vehicle information request. The vehicle search unit 53 sends the data of the search result (that is, the vehicle information satisfying the search conditions included in the vehicle information request) to the client terminal 90 via the communication unit 51 as a response to the vehicle information request.

The processor 92 of the client terminal 90 receives and acquires the data of the search result sent from the vehicle search server 50 via the communication unit 93. The processor 92 generates the search result screen WD2 using the data of the search result and displays it on the display 94 (St2-3).

In FIG. 22, the processor 92 sends an acquisition request of the case data to the vehicle search server 50 via the communication unit 93 to read the case data stored in the case DB 56*b* of the vehicle search server 50 (St4-1). The vehicle search server 50 reads the case data (specifically, a vehicle thumbnail image, map information, and information indicating the flow-in/flow-out directions of a vehicle) corresponding to the acquisition request sent from the client terminal 90 from the case DB56*b* and sends it to the client terminal 90. The processor 92 of the client terminal 90 acquires the case data sent from the vehicle search server 50 (St4-2).

The processor 92 repeats the loop processing consisting of Steps St4-3, St4-4, and St4-5 for each case data using the corresponding case data (that is, individual case data corresponding to the number of vehicle thumbnail images) acquired in Step St4-2 to generate and display the case screen WD3 (see FIG. 17, for example).

Specifically, in the loop processing performed for each registered vehicle (in other words, vehicle corresponding to the vehicle thumbnail image included in the case data), the processor 92 arranges and displays the vehicle thumbnail image on the case screen WD3 (St4-3) and arranges and displays the map when the registered vehicle passes through the intersection on the case screen WD3 (St4-4), and then the processor 92 displays the respective directions indicating the flow-in and flow-out directions of the vehicle in a state where the respective directions are superimposed on the map (St4-5).

Figure 23:
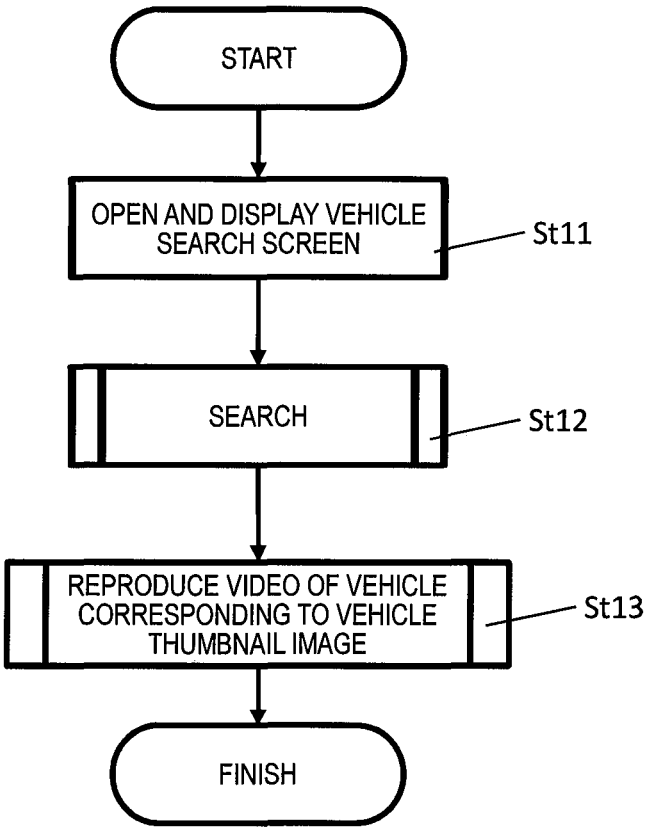
FIG. 23 is a flowchart illustrating an example of an operation procedure of motion reproduction of a vehicle corresponding to the vehicle thumbnail image.
Figure 24:
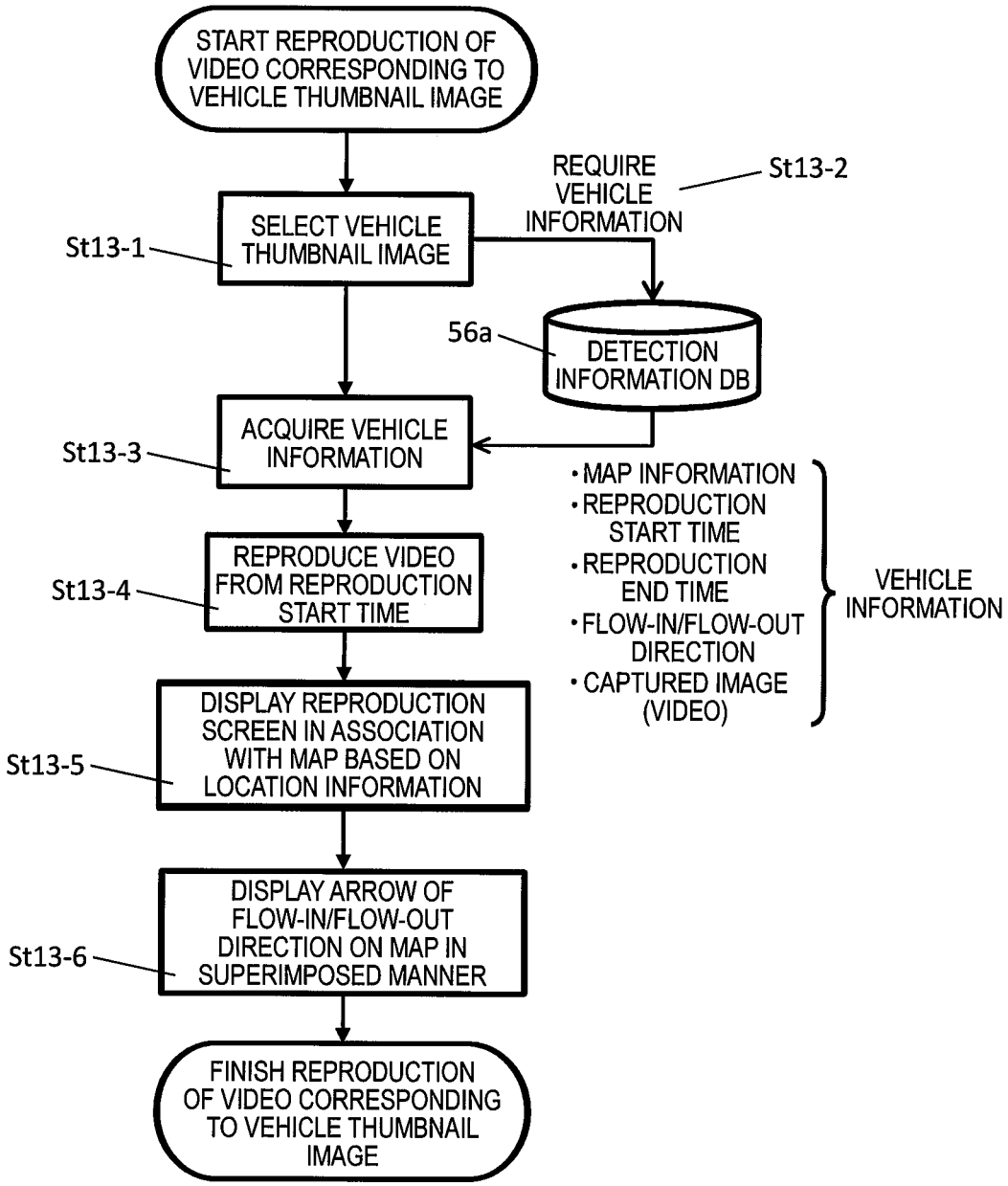
FIG. 24 is a flowchart illustrating an example of a detailed operation procedure of Step St13 in FIG. 23.

FIG. 23 is a flowchart illustrating an example of an operation procedure of motion reproduction of the vehicle corresponding to the vehicle thumbnail image. FIG. 24 is a flowchart illustrating an example of a detailed operation procedure of Step St13 in FIG. 23.

In FIG. 23, when a user executes an activation operation of the vehicle detection application, the processor 92 of the client terminal 90 activates and executes the vehicle detection application and displays the vehicle search screen WD1 (see FIG. 8, for example) on the display 94 (St11). After Step St11, the processor 92 generates the vehicle information request based on a user's operation for inputting various search conditions to the vehicle search screen WD1 and sends the vehicle information request to the vehicle search server 50 via the communication unit 93 to execute the search (St12).

The processor 92 receives and acquires the data of the vehicle search result obtained by the search of the vehicle search server 50 in Step St2 via the communication unit 93 and generates and displays the search result screen WD2 (see FIG. 11, for example). The processor 92 accepts selection of one of the vehicle thumbnail images of the vehicle candidates displayed on the search result screen WD2 by a user's operation and reproduces the captured image (video) corresponding to the selected vehicle thumbnail image (St13). Since the detailed operation procedure of Step St12 is the same as the content described with reference to FIG. 21, the description of Step St12 will not be repeated.

In FIG. 24, when selection of one of the vehicle thumbnail images of the vehicle candidates displayed on the search result screen WD2 is accepted (St13-1), the processor 92 generates the vehicle information request for requesting acquisition of vehicle information corresponding to the selected vehicle thumbnail image (St13-2). The processor 92 sends the vehicle information request generated in Step St13-2 to the vehicle search server 50 via the communication unit 93.

Based on the vehicle information request sent from the client terminal 90, the vehicle search unit 53 of the vehicle search server 50 searches the detection information DB 56*a* of the storage unit 56 for the vehicle information of the vehicle thumbnail image corresponding to the vehicle information request. The vehicle search unit 53 sends the data (that is, the vehicle information of the vehicle thumbnail image selected by a user) of the search result to the client terminal 90 via the communication unit 51 as a response to the vehicle information request.

The processor 92 of the client terminal 90 receives and acquires the data of the search result sent from the vehicle search server 50 via the communication unit 93. The processor 92 acquires the data of the search result (St13-3). The data of the search result includes, for example, the location information (that is, the position information of the intersection), the reproduction start time of the captured image in which the vehicle is captured, the reproduction end time of the captured image in which the vehicle is captured, the captured image of the camera from the reproduction start time to the reproduction end time, and the flow-in/flow-out direction of the vehicle with respect to the intersection.

After the data of the search result is acquired in Step St13-3, the processor 92 displays the image reproduction dialog DLG1 (see FIG. 12) on the search result screen WD2 in a superimposed manner and starts the reproduction of the captured image of the camera from the reproduction start time in the reproduction screen MOV1 of the image reproduction dialog DLG1 (St13-4). In addition, the processor 92 arranges and displays the passing direction screen CRDR1 including the road map MP1 based on the location information acquired in Step St13-3 in association with the reproduction screen MOV1 (St13-5). Further, the processor 92 superimposes and displays the flow-in/flow-out direction acquired in Step St13-3 on the respective positions immediately before and immediately after the corresponding intersection in the passing direction screen CRDR1 (St13-6).

As described above, the vehicle detection system 100 according to the first embodiment includes the vehicle search server 50 connected to be able to communicate with the cameras 10, 10*a*, . . . installed at intersections and the client terminal 90 connected to be able to communicate with the vehicle search server 50. In accordance with the input of information including the date and time and the location at which an incident or the like occurs and the features of the vehicle causing the incident or the like, the client terminal 90 sends an information acquisition request of the vehicle which passes through the intersection at the location at the date and time to the vehicle search server 50. Based on the information acquisition request, the vehicle search server 50 extracts the vehicle information and the passing direction of the vehicle passing through the intersection at the location in association with each other by using the captured image of the camera corresponding to the intersection at the location at the date and time and sends the extraction result to the client terminal 90. The client terminal 90 displays the visual features of the vehicle passing through the intersection at the location and the passing direction of the vehicle on the display 94 using the extraction result.

Therefore, when an incident or the like occurs at an intersection where many people and vehicles come and go, a user can simultaneously grasp, at an early stage, the visual features of the vehicle candidates or the likes extracted as the getaway vehicle and the getaway direction at the time of passing through the intersection in the client terminal 90 used by him or herself. Therefore, the vehicle detection system 100 can efficiently support the early detection of the getaway vehicle in the investigation by the user, so that the convenience of police investigation and the like can be accurately improved.

Further, the client terminal 90 displays a still image illustrating the appearance of the vehicle as visual information of the vehicle (see FIG. 17, for example). As a result, a user can visually and intuitively grasp a still image (for example, a vehicle thumbnail image) illustrating the appearance of the vehicle while searching for the getaway vehicle and can quickly determine the presence or absence of a suspicious getaway vehicle.

The client terminal 90 holds the information of the road map MP1 indicating the position of the intersection at which the camera is installed and displays the passing direction in a state where the passing direction is superimposed on the road map MP1 in a predetermined range including the intersection at the location (see FIG. 17, for example). Therefore, when a user searches for the getaway vehicle, the user can grasp the position on the road map MP of the intersection where the vehicle has passed in contrast with the appearance (that is, the vehicle thumbnail image) of the vehicle, and thus it is possible to accurately grasp the position of the intersection where the vehicle with suspicion of the getaway vehicle has passed.

The client terminal 90 creates an information acquisition request based on the information (that is, the search condition input by a user's operation) including the passing direction of a vehicle in the intersection at the location which is input by a user's operation. Therefore, the client terminal 90 can create the information acquisition request using various search conditions input by a user's operation and can easily make the vehicle search server 50 execute search of the vehicle information.

In response to a user's operation on the visual information of the vehicle displayed on the display 94, the client terminal 90 displays the suspect candidate mark (an example of candidate marks) of the vehicle on which the suspect of an incident or the like rides near the vehicle. Therefore, a user can assign the suspect candidate mark to the thumbnail image of the vehicle with possibility of the getaway vehicle on which the suspect of an incident or the like rides, it is possible to easily check the vehicles concerned when looking back the plurality of vehicle thumbnail images obtained as the search results, and thus the convenience at the time of investigation is improved.

Further, the client terminal 90 switches and displays the rank (an example of the type) of the suspect candidate mark indicating the possibility of being a suspect in response to a user's operation on the suspect candidate mark. As a result, a user can change the rank of the suspect candidate mark for convenience under the determination that the vehicle to which the suspect candidate mark is given is highly likely or is likely to be the getaway vehicle. Therefore, for example, suspect candidate marks which can distinguish vehicles of particular concern or vehicles which are not so concerned can be given, and thus the convenience at the time of investigation is improved.

The client terminal 90 displays a reproduction icon capable of instructing the reproduction of the captured image of the camera which captured the vehicle on the visual information of the vehicle in a superimposed manner in response to a user's operation on the visual information of the vehicle displayed on the display 94 (see FIG. 18, for example). As a result, a user can easily view the captured image when a vehicle which is the concerned vehicle in the vehicle thumbnail images displayed on the search result screen WD2 passes through the intersection.

In response to a user's operation (for example, a user's operation for closing the display window frame of the vehicle thumbnail image) on the visual information of the vehicle displayed on the display 94, the client terminal 90 hides the display of the visual feature of the vehicle and the passing direction of the vehicle. Therefore, a user enjoys the way that the vehicle thumbnail image and the passing direction of the vehicle displayed in the display window frame of the vehicle thumbnail image to be not necessary are closed and it is possible to intuitively grasp that the video of the vehicle corresponding to which vehicle thumbnail image is reproduced.

Further, the client terminal 90 displays on the display 94 the visual features of the vehicle passing through the intersection at the location, the passing direction of the vehicle, and the input information (for example, the search condition) in association with one another. Therefore, a user can confirm the search condition of the getaway vehicle and the data of the search result of the vehicle side by side in association with each other.

The client terminal 90 also displays on the display 94 the image reproduction dialog DLG1 including the reproduction screen MOV1 of the captured image of the camera installed at the intersection at the location as the visual information of the vehicle. Therefore, since a user can easily view the captured image showing the state of the movement of the vehicle while searching for the getaway vehicle, it is possible to quickly determine whether the vehicle is a suspicious getaway vehicle.

Further, the client terminal 90 holds the information of the road map MP1 indicating the position of the intersection where the camera is installed and displays the image reproduction dialog DLG1 including a screen (for example, the passing direction screen CDRD1) in which the passing direction is displayed on the road map MP1 of a predetermined range including the intersection at the location in a superimposed manner. Therefore, when a user searches for the getaway vehicle, the user can grasp the position on the road map MP of the intersection where the vehicle has passed, in contrast to the video of the vehicle, and therefore, the user can accurately grasp the position of the intersection where the vehicle with suspicion of the getaway vehicle has passed.

Further, the client terminal 90 displays and reproduces the image for a predetermined period from entry (flow-in) of the vehicle to the intersection to exit (flow-out) thereof in the reproduction screen MOV1. As a result, the user can watch the state when the concerned vehicle passes through the intersection in the reproduction screen MOV1 of the image reproduction dialog DLG1, thereby improving the convenience at the time of investigation.

Further, the client terminal 90 rotates and displays the road map MP1 so as to coincide with the direction of the image capturing angle of view of the camera in response to a user's operation on the road map MP1. Therefore, the user visually correlates the reproduction screen MOV1 of the captured image and the passing direction when the vehicle has passed through the intersection, so that the user can more easily recognize them.

Further, the client terminal 90 displays the suspect candidate mark of the vehicle on which a suspect of an incident or the like rides in the vicinity of the reproduction screen MOV1 in response to a user's operation on the image reproduction dialog DLG1. As a result, a user can assign the suspect candidate mark in the vicinity of the reproduction screen MOV1 of the captured image of the vehicle corresponding to the vehicle thumbnail image with the possibility of the getaway vehicle on which a suspect of an incident or the like rides, the user who viewed the captured image can easily assign a mark which indicates that the vehicle is a concerned vehicle. As a result, the convenience at the time of investigation is improved.

In addition, the client terminal 90 displays the passing direction of the vehicle in a state where the passing direction of the vehicle is changed in accordance with a user's operation on the image reproduction dialog DLG1. Therefore, when a user who viewed the captured image reproduced in the reproduction screen MOV1 discovers that, for example, the passing direction of the vehicle displayed in the image reproduction dialog DLG1 differs from the actual travelling direction of the vehicle, the user can easily modify the passing direction of the vehicle even when it is incorrectly recognized by the video analysis of the vehicle search server 50, for example.

The client terminal 90 is connected to be able to communicate with the video recorder 70 for recording the captured images of the camera. The client terminal 90 acquires the captured image of the camera from the video recorder 70 in accordance with a user's operation on the image reproduction dialog DLG1 and displays and reproduces another image reproduction screen different from the image reproduction dialog DLG1. Therefore, a user can view an image of time other than the reproduction time in the reproduction screen MOV1 of the image reproduction dialog DLG1 or can view the captured image on another image reproduction screen by performing zoom processing such as enlargement or reduction on the image.

In addition, the client terminal 90 hides the other image reproduction screens according to a user's operation of hiding the image reproduction dialog DLG1. Therefore, a user can hide other image reproduction screens simply by hiding (that is, closing) the image reproduction dialog DLG1 without performing an operation for hiding other image reproduction screens, and thus the convenience at the time of operation is improved.

Further, the client terminal 90 displays an attention frame (an example of a frame) of a predetermined shape on the vehicle in a superimposed manner while the vehicle enters (flows into) the intersection and exits (flows out) the intersection. Therefore, a user can visually and intuitively grasp the existence of the targeted vehicle in the reproduction screen MOV1, and thus the convenience of investigation can be improved.

Background to Modification Example of First Embodiment

In JP-A-2007-174016, when an incident or the like occurs at the travelling route (for example, an intersection where many people and vehicles come and go) of a vehicle, it is not considered to output a report in which the getaway direction of the vehicle or the like which caused the incident or the like is associated with the captured image of the vehicle or the like at that time. Such reports are created each time the police investigation is performed and also recorded as data, and thus it is considered useful for verification.

In the following modification example of the first embodiment, a vehicle detection system and a vehicle detection method in which, when an incident or the like occurs at an intersection where many people and vehicles come and go, a report correlating a captured images of a getaway vehicle or the like and a getaway direction when the vehicle passes through an intersection is created so that the convenience of investigation by the police or the like is accurately improved.

Modification Example of First Embodiment

The configuration of the vehicle detection system 100 according to the modification example of the first embodiment is the same as that of the vehicle detection system 100 according to the first embodiment. Further, the descriptions of the same configuration will be simplified or omitted by assigning the same reference numerals and letters and the descriptions of different contents will be explained.

Figure 25:
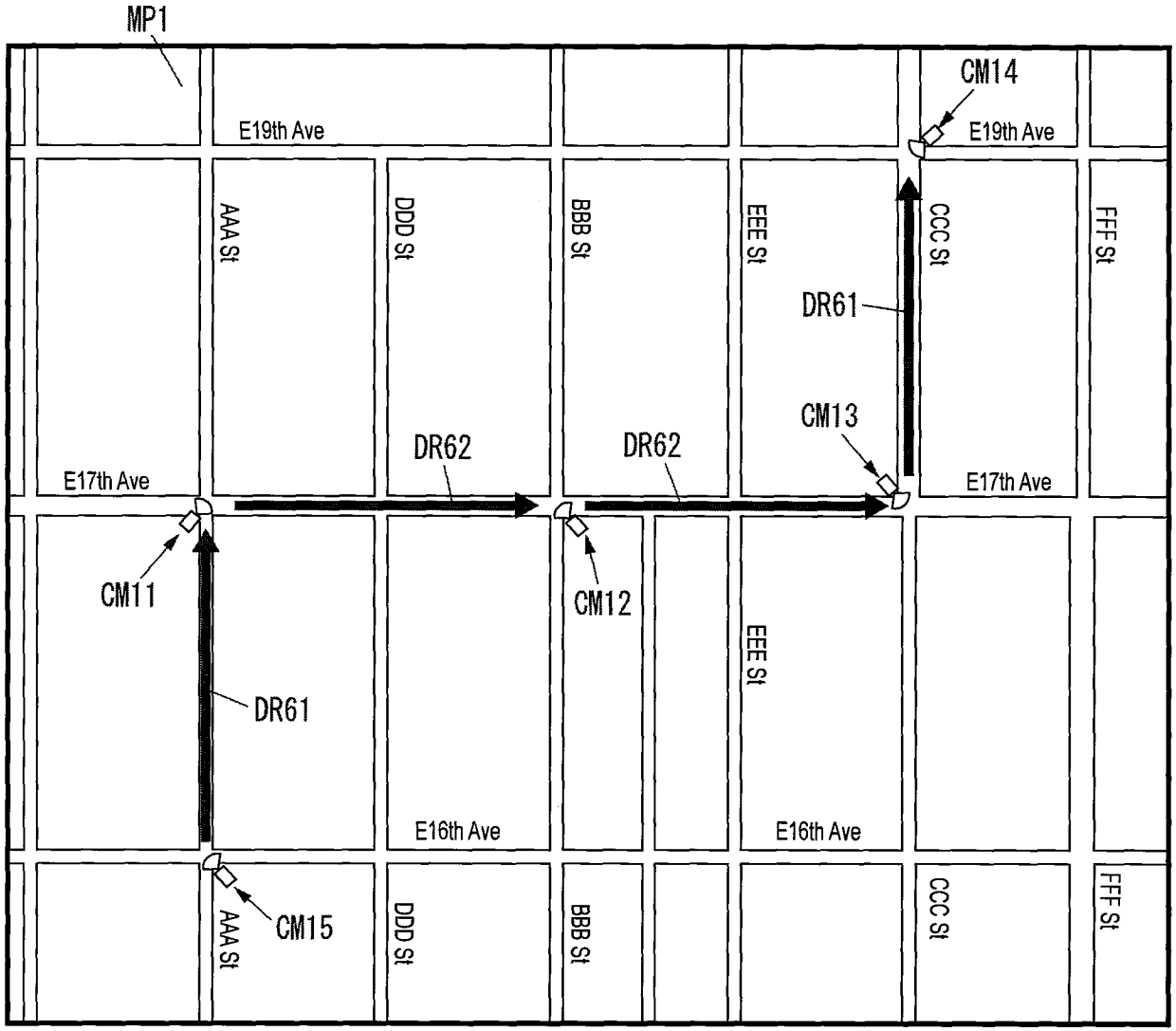
FIG. 25 is an explanatory diagram illustrating an example of a vehicle getaway scenario as a prerequisite for creating a case report.
Figure 26:
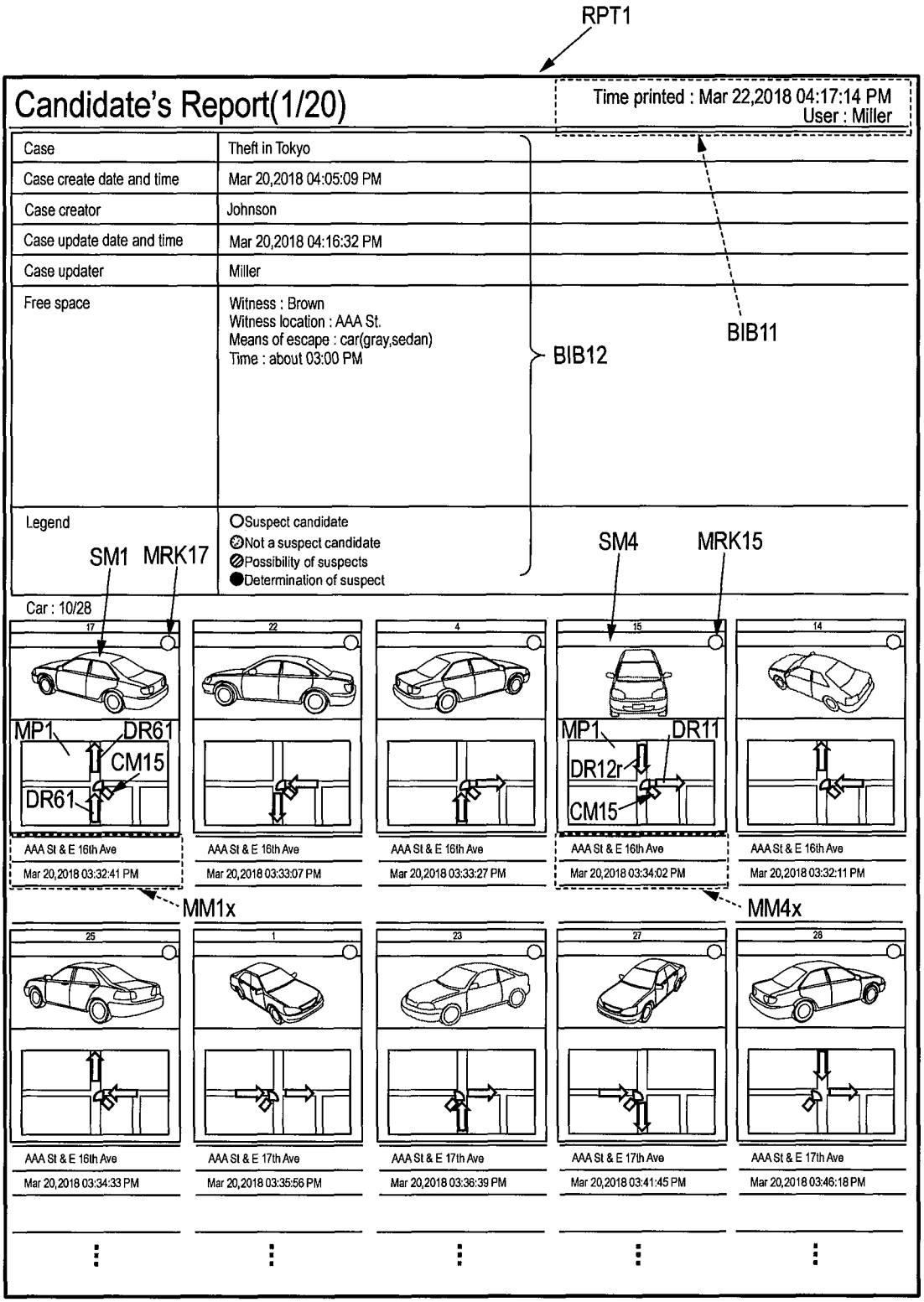
FIG. 26 is a diagram illustrating a first example of the case report.
Figure 27:
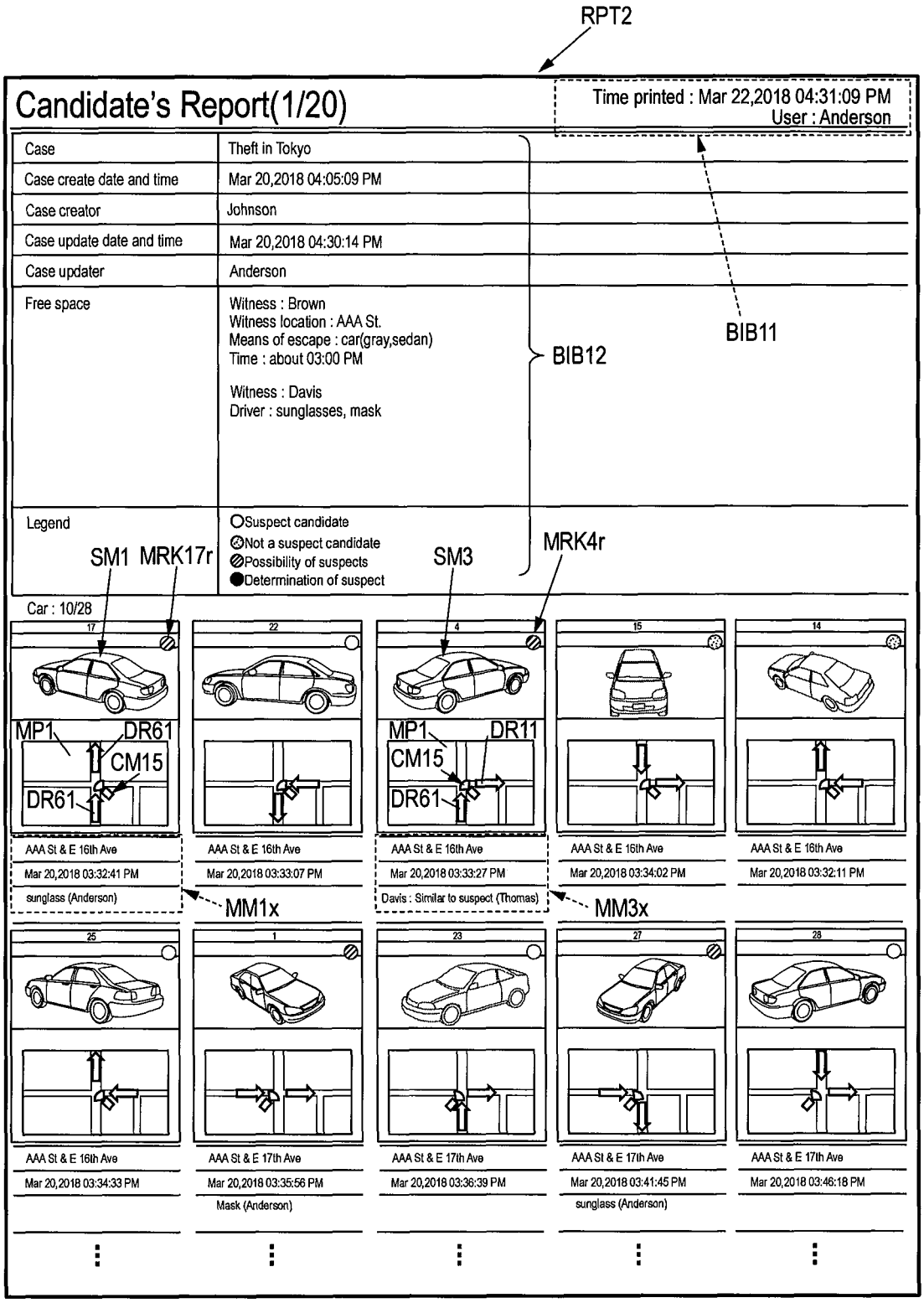
FIG. 27 is a diagram illustrating a second example of the case report.
Figure 28:
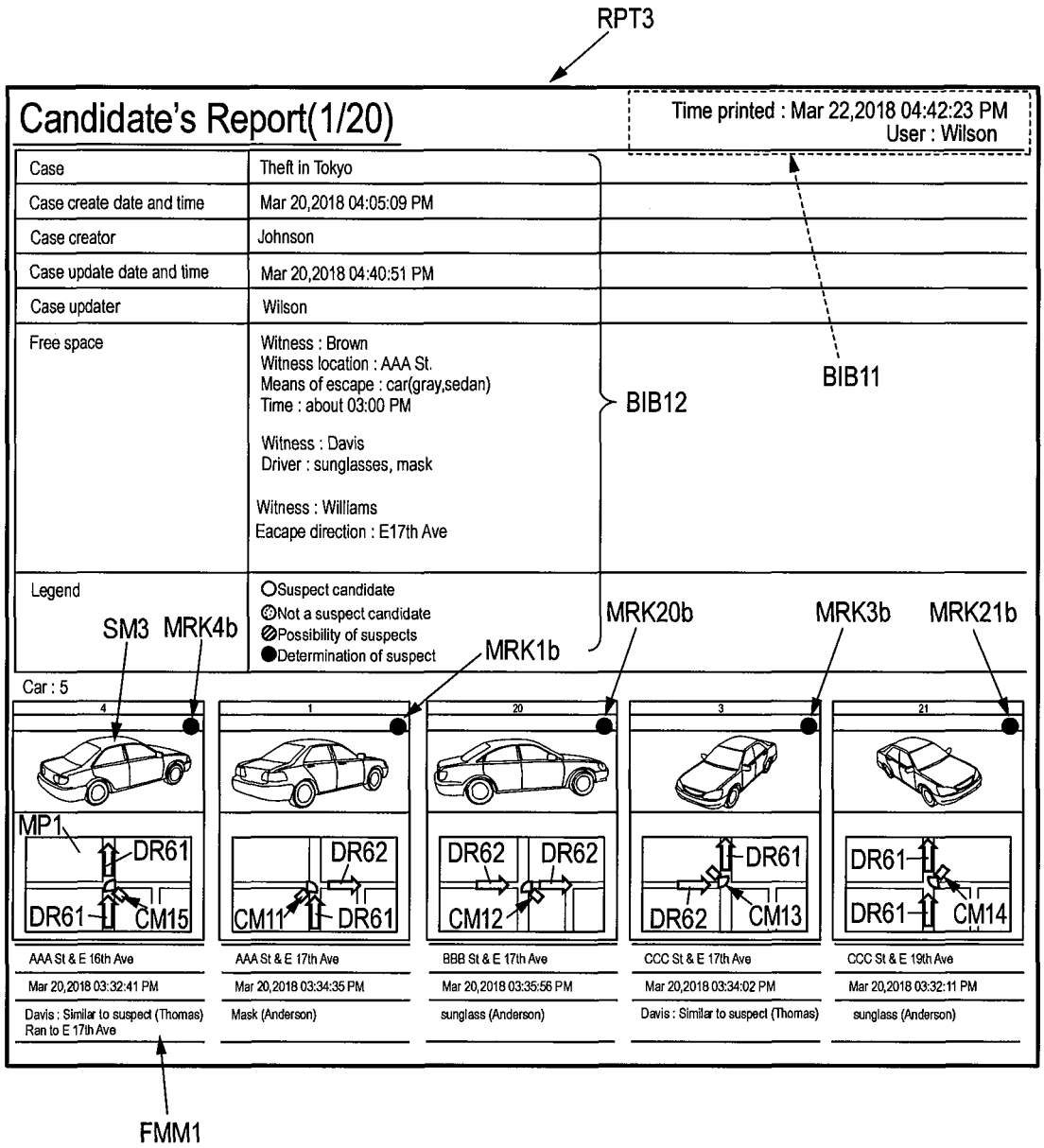
FIG. 28 is a diagram illustrating a third example of the case report.

FIG. 25 is an explanatory diagram illustrating an example of a vehicle getaway scenario as a prerequisite for creating a case report. FIG. 26 is a diagram illustrating a first example of the case report. FIG. 27 is a diagram illustrating a second example of the case report. FIG. 28 is a diagram illustrating a third example of the case report.

FIG. 25 illustrates the vehicle getaway scenario on the road map MP1 which is a prerequisite for creating the case reports RPT1, RPT2, and RPT3 illustrated in FIGS. 26, 27, and 28, in which the time period of the report information from a witness of an incident or the like is from 3:30 pm to 4:00 pm and the vehicle is a gray sedan.

The vehicle (that is, the getaway vehicle) on which a person such as a suspect who caused the incident or the like rides moves northwards along a direction DR61 on a road "AAA St." facing an intersection of "AAA St. & E16th Ave" where a camera CM15 is installed and the vehicle turns right at an intersection of "AAA St. & E17th Ave" where a camera CM11 is installed, and then the vehicle heads east along a direction DR62. The internal configurations of cameras CM11, CM12, CM13, CM14, and CM15 are the same as the internal configurations of the cameras 10, 10*a*, . . . illustrated in FIG. 2, as similar to the cameras CM1 to CM5.

Then, the vehicle goes straight through an intersection of "BBB St. & E17th Ave" where the camera CM12 is installed and heads east along a direction DR62.

Then, the vehicle turns left at an intersection of "CCC St. & E17th Ave" where the camera CM13 is installed and heads north along the direction DR 61.

Then, the vehicle enters (flow in) an intersection of "CCC St. & E19th Ave" where the camera CM14 is installed.

A case report RPT1 illustrated in FIG. 26 is created by the processor 92 and displayed on the display 94 when the processor 92 detects that the "Print/PDF" icon ICO11 of the case screen WD3 illustrated in FIG. 18 is pressed by a user's operation. The case report RPT1 has a configuration in which bibliographic information BIB11 and BIB12 of a specific case and a combination of the vehicle thumbnail image displayed on the case screen WD3 and the passing direction of the vehicle when the vehicle passes through the intersection, the passing direction being superimposed on the road map MP1, are arranged.

The bibliographic information BIB11 includes the date and time (for example, May 22, 2018, 04:17:14 PM) at which the case report RPT1 was printed out and the user name (for example, Miller). The user name indicates the name of a user of the vehicle detection application.

The bibliographic information BIB12 includes the title of a case, the case occurrence data and time (Case create date and time), the Case creator, the Case update date and time, the Case updater, the remarks field (Free space), and the caption (Legend).

The title of a case indicates, for example, the title of a case report and "Theft in Tokyo" is illustrated in the example of FIG. 26.

The Case create date and time indicates, for example, the date and time when case data related to the case report RPT1 including the vehicle search result or the like using the search condition of the vehicle search screen WD1 is created and "May 20, 2018, 04:05:09 PM" is illustrated in the example of FIG. 26.

The Case creator indicates, for example, the name of a police officer who is a user who creates the case data and "Johnson" is illustrated in the example of FIG. 26.

The Case update date and time indicates, for example, the date and time when the case data once created is updated and "May 20, 2018, 04:16:32 PM" is illustrated in the example of FIG. 26.

The Case updater indicates, for example, the name of a police officer who is a user who updates the contents of the case data once created and "Miller" is illustrated in the example of FIG. 26.

In the remarks column, information obtained as information on the investigation by a user is input and, for example, the Witness (for example, "Brown"), the Witness location (for example, "AAA St."), the Means of getaway (for example, "car (gray sedan)", and the Time (for example, about 03:00 PM) are input.

In the caption, an explanation of the rank (for example, color) of the suspect candidate mark is described. A yellow suspect candidate mark indicates that the car is suspicious as the candidate of a getaway vehicle of a suspect. A white suspect candidate mark indicates that the vehicle is not the candidate of a getaway vehicle of a suspect. A red suspect candidate mark indicates that the vehicle is quite suspicious as the candidate of a getaway vehicle of a suspect more than the possibility of the yellow suspect candidate mark. A black suspect candidate mark indicates that the vehicle is definitely suspicious as the candidate of a getaway vehicle of a suspect.

In the case report RPT1, a combination of the vehicle thumbnail image (for example, the vehicle thumbnail images SM1, SM4, . . . ) and the passing direction of the vehicle when the vehicle passes through the intersection, the passing direction being superimposed on the road map MP1, is shown for each of a total of twenty-eight vehicle candidates. When the suspect candidate mark (for example, the suspect candidate mark MRK17 or MRK15) is given, it is displayed near the corresponding vehicle thumbnail image.

It is illustrated that, for example, the vehicle of the vehicle thumbnail image SM1 flows into the intersection of "AAA St. & E16th Ave" where the camera CM15 is installed in the direction DR61 at 03:32:41 PM on May 20, 2018 and flows out from the intersection with maintaining the direction DR61. That is, bibliographic information MM1*x* relating to the date and time at which the vehicle of the vehicle thumbnail image SM1 passed through the intersection and the intersection at the location are illustrated in association with the vehicle thumbnail image SM1 and the passing direction when the vehicle passed through the intersection.

It is illustrated that, for example, the vehicle of the vehicle thumbnail image SM4 flows into the intersection of "AAA St. & E16th Ave" where the camera CM15 is installed in the direction DR12*r* at 03:34:02 PM on May 20, 2018 and flows out from the intersection in the direction DR11. That is, bibliographic information MM4*x* relating to the date and time at which the vehicle of the vehicle thumbnail image SM4 passed through the intersection and the intersection at the location are illustrated in association with the vehicle thumbnail image SM4 and the passing direction when the vehicle passed through the intersection.

A case report RPT2 illustrated in FIG. 27 is created by the processor 92 and displayed on the display 94 when the processor 92 detects that the "Print/PDF" icon ICO11 of the case screen WD3 illustrated in FIG. 18 is pressed by a user's operation. The case report RPT2 has a configuration in which the bibliographic information BIB11 and BIB12 of a specific case and a combination of the vehicle thumbnail image displayed on the case screen WD3 and the passing direction of the vehicle when the vehicle passes through the intersection, the passing direction being superimposed on the road map MP1, are arranged. In the descriptions of the case reports RPT2 and RPT3 in FIGS. 27 and 28, the elements similar to those of the case report RPT1 in FIG. 26 are denoted by the same reference numerals and letters and the descriptions thereof are simplified or omitted, and further, different contents will be described.

In the case report RPT2 of FIG. 27, the bibliographic information BIB11 includes the date and time (for example, May 22, 2018, 04:31:09 PM) at which the case report RPT2 was printed out and the user name (for example, Anderson).

The Case update date and time indicates, for example, the date and time when the case data once created is updated and "May 20, 2018, 04:30:14 PM" is illustrated in the example of FIG. 27.

The Case updater indicates, for example, the name of a police officer who is a user who updates the contents of the case data once created and "Anderson" is illustrated in the example of FIG. 27.

In the remarks column, information obtained as information on the investigation by a user is input and, for example, the witnesses (for example, "Davis") and information (for example, "wearing sunglasses and mask") on a driver of the getaway vehicle are input in addition to the contents of the remarks column illustrated in FIG. 26.

In the example of FIG. 27, the suspect candidate mark of the vehicle of the vehicle thumbnail image SM1 is changed to the suspect candidate mark MRK17*r* of red. This is because the rank of the suspect candidate mark of the vehicle of the vehicle thumbnail image SM1 is changed from yellow to red by a user's operation before the case report RPT2 is created. In addition, compared with the content of the bibliographic information MM1*x* illustrated in FIG. 26, the content of "sunglasses" listed in the remarks column of the bibliographic information BIB12 is added to the content of the bibliographic information MM1*x* in the case report RPT2 illustrated in FIG. 27 by the operation of the police officer "Anderson". "Sunglasses" shows a characteristic element which serves as a clue to a criminal or the like who rides on the getaway vehicle, for example.

It is illustrated that, for example, the vehicle of the vehicle thumbnail image SM3 flows into the intersection of "AAA St. & E16th Ave" where the camera CM15 is installed in the direction DR61 at 03:33:27 PM on May 20, 2018 and flows out from the intersection in the direction DR11. That is, bibliographic information MM3*x* relating to the date and time at which the vehicle of the vehicle thumbnail image SM3 passed through the intersection and the intersection at the location are illustrated in association with the vehicle thumbnail image SM3 and the passing direction when the vehicle passed through the intersection.

In the example of FIG. 27, the suspect candidate mark of the vehicle of the vehicle thumbnail image SM3 is changed to a suspect candidate mark MRK4*r* of red. This is because the rank of the suspect candidate mark of the vehicle of the vehicle thumbnail image SM3 is changed from yellow to red by a user's operation before the case report RPT2 is created.

A case report RPT3 illustrated in FIG. 28 is created by the processor 92 and displayed on the display 94 when the processor 92 detects that the "Print/PDF" icon ICO11 of the case screen WD3 illustrated in FIG. 18 is pressed by a user's operation. The case report RPT3 has a configuration in which the bibliographic information BIB11 and BIB12 of a specific case and a combination of the vehicle thumbnail image displayed on the case screen WD3 and the passing direction of the vehicle when the vehicle passes through the intersection, the passing direction being superimposed on the road map MP1, are arranged.

In a case report RPT3, the candidates for the getaway vehicle are further narrowed from the contents of the case report RPT1 or the case report RPT2 by a user and the vehicle thumbnail image to which a rank (for example, black) indicating the most suspicious suspect candidate mark is given and the passing direction when the vehicle corresponding to the vehicle of the vehicle thumbnail image passes through the intersection are associated with each other. In the example of FIG. 28, the identification numbers of the vehicle thumbnail images are different as "4", "1", "20", "3", and "21", but they all indicate the same vehicle. Thus, according to the case report RPT3, a user can clearly grasp the getaway route (see FIG. 25) of the getaway vehicle.

In the case report RPT3 of FIG. 28, the bibliographic information BIB11 includes the date and time (for example, May 22, 2018, 04:42:23 PM) at which the case report RPT3 was printed out and the user name (for example, Wilson).

The Case create date and time indicates, for example, the date and time when case data related to the case report RPT3 including the vehicle search result or the like using the search condition of the vehicle search screen WD1 is created and "May 20, 2018, 04:05:09 PM" is illustrated in the example of FIG. 28.

The Case update date and time indicates, for example, the date and time when the case data once created is updated and "May 20, 2018, 04:40:51 PM" is illustrated in the example of FIG. 28.

The Case updater indicates, for example, the name of a police officer, a user who updated the content of the case data once created and "Wilson" is illustrated in the example of FIG. 27.

In the remarks column, information obtained as information on the investigation by a user is input and, for example, the witnesses (for example, "William") and information (for example, "E17th Ave") on the getaway direction of the getaway vehicle are input in addition to the contents of the remarks column illustrated in FIG. 27.

In the example of FIG. 28, the suspect candidate mark of the vehicle of the vehicle thumbnail image SM3 is changed to a black suspect candidate mark MRK4*b*. This is because the rank of the suspect candidate mark of the vehicle of the vehicle thumbnail image SM3 is changed from red (see FIG. 27) to black by a user's operation before the case report RPT3 is created. In the example of FIG. 28, a memo FMM1 of the creator or the updater is displayed below the display area of the time when the vehicle passes through the intersection. In the memo FMM1, it is illustrated by the user "Thomas" that a vehicle similar to the getaway vehicle has passed through "E17th Ave" according to the eyewitness testimony of the witness "Davis".

As described above, in the example of FIG. 28, the suspect candidate marks of the respective vehicles (the same vehicle) of the identification numbers "1", "20", "3", and "21" of the vehicle thumbnail images are changed to black suspect candidate mark MRK1*b*, MRK20*b*, MRK3*b*, and MRK21*b*. This is because the ranks of the suspect candidate marks of the vehicles of the corresponding vehicle thumbnail images are changed from yellow or red to black by the operation of a user who determines that the vehicles are definitely suspicious as the getaway vehicle before the case report RPT3 is created.

Figure 29:
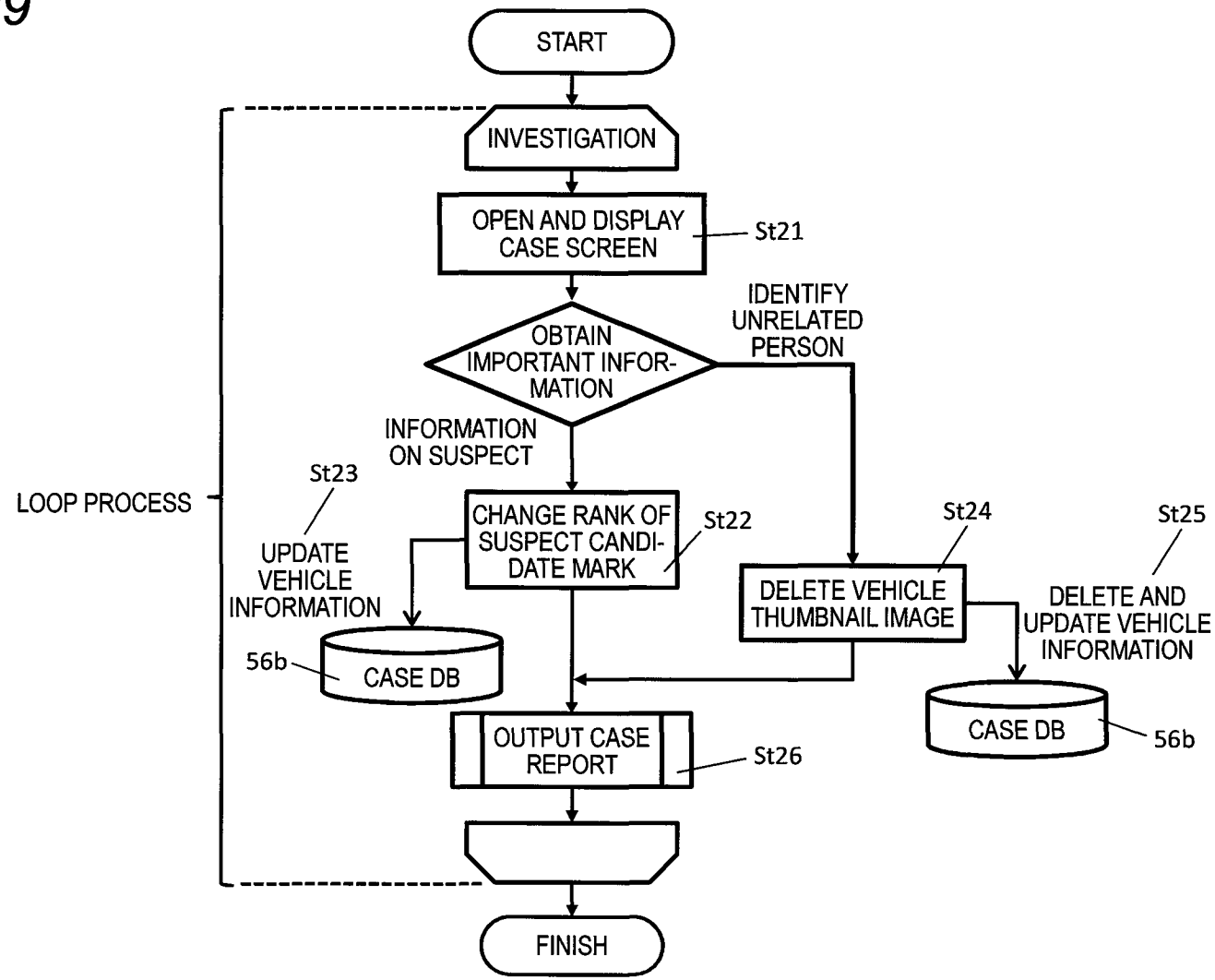
FIG. 29 is a flowchart illustrating an example of an operation procedure from the initial investigation to the output of the case report.
Figure 30:
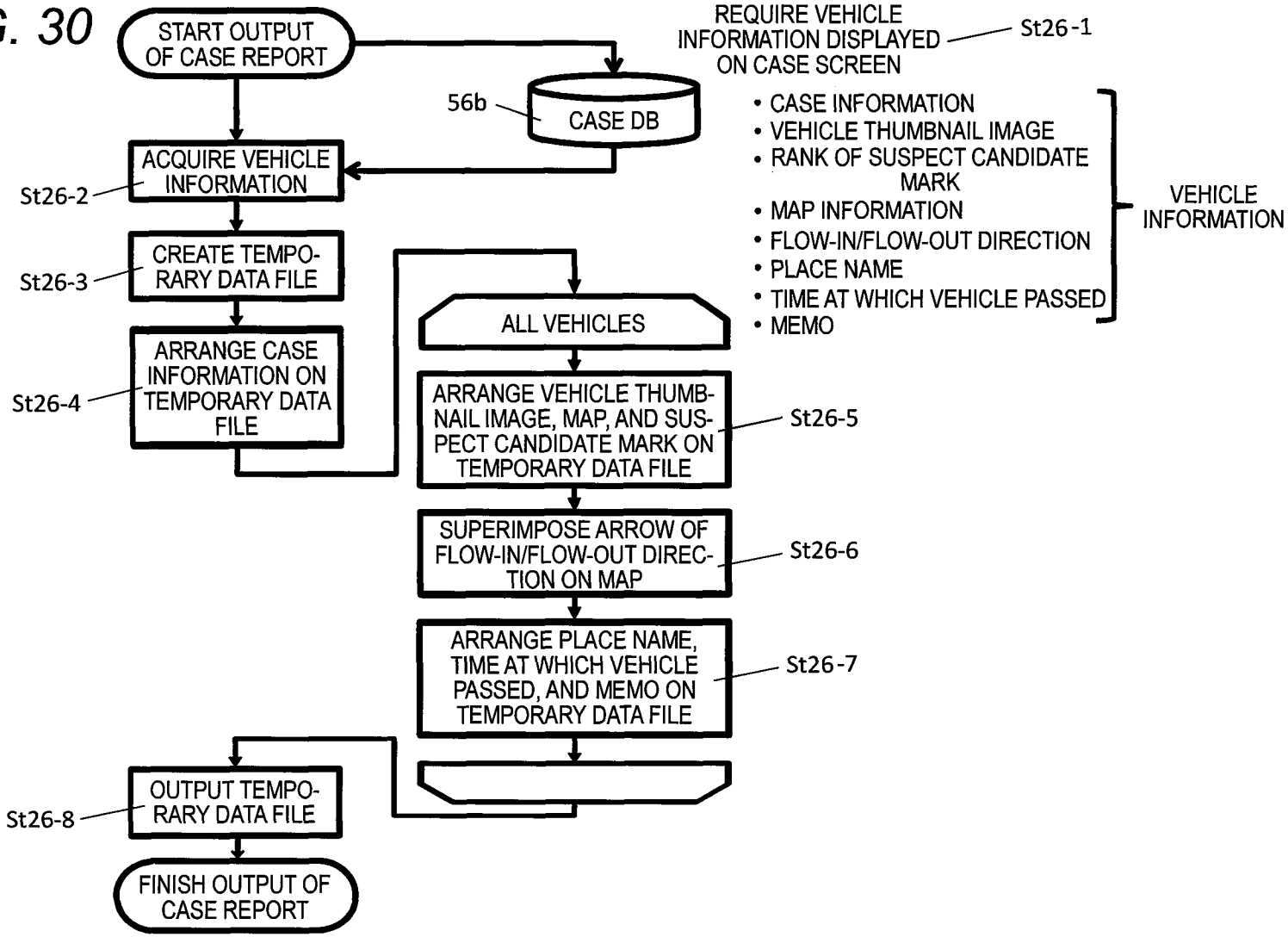
FIG. 30 is a flowchart illustrating an example of a detailed operation procedure of Step St26 in FIG. 29.

Next, the operation procedure of the vehicle detection system 100 according to a modification example of the first embodiment will be described with reference to FIGS. 29 and 30. In FIGS. 29 to 30, the explanation is mainly focused on the operation of the client terminal 90 and the operation of the vehicle search server 50 is complementarily explained as necessary.

FIG. 29 is a flowchart illustrating an example of an operation procedure from the initial investigation to the output of the case report. FIG. 30 is a flowchart illustrating an example of a detailed operation procedure of Step St26 in FIG. 29. The flowchart of FIG. 29 is repeatedly executed as a loop process as long as the police investigation is in progress.

In FIG. 29, when a user executes an activation operation of the vehicle detection application, the processor 92 of the client terminal 90 activates and executes the vehicle detection application and displays the case screen WD3 (see FIG. 17, for example) on the display 94 by a user's operation for opening the case screen WD3 (St21). Here, when important information (for example, information on a getaway vehicle on which a suspect rides) on investigation is obtained by reporting (for example, telephone call) from a reporting person such as a witness, the processor 92 changes the rank of the suspect candidate mark given to the vehicle thumbnail image in the list of the vehicle thumbnail images displayed on the case screen WD3, the vehicle thumbnail image matching the important information, based on a user's operation (St22).

After Step St22 is performed, the processor 92 sends the information on the rank of the changed suspect candidate mark to the vehicle search server 50 via the communication unit 93 to update the information on the rank (St23). The vehicle search server 50 receives and acquires the information on the rank of the suspect candidate mark sent from the client terminal 90, changes (updates) the rank of the suspect candidate mark in association with the vehicle thumbnail image, and stores it in the case DB 56*b*.

On the other hand, when information on vehicles not related to the incident or the like is obtained in relation to the vehicle thumbnail images displayed on the already created case screen WD3, the processor 92 deletes (specifically, does not display the vehicle thumbnail image on the case screen WD3) the vehicle thumbnail image corresponding to the unrelated vehicle based on a user's operation (St24).

After Step St24 is performed, the processor 92 sends information on the unrelated vehicle thumbnail image to the vehicle search server 50 via the communication unit 93 to update that the unrelated vehicle thumbnail image has been deleted (St25). The vehicle search server 50 receives and acquires the information on the unrelated vehicle thumbnail image sent from the client terminal 90 and deletes the information on the vehicle thumbnail image from the case DB 56*b*.

After Step St24 or Step St25 is performed, the processor 92 creates and outputs a case report by a user's operation (St26). The output form is not limited to, for example, a form in which the data of the case report is sent to a printer (not illustrated) connected to the client terminal 90 and printed out from the printer and may be a form in which data (for example, data in PDF format) of the case report (see FIGS. 26 to 28, for example) is created.

In FIG. 30, when an instruction to output the case report by a user's operation is received, the processor 92 creates a request for vehicle information including the vehicle thumbnail images currently displayed on the case screen WD3 and sends it to the vehicle search server 50 via the communication unit 93 (St26-1).

The vehicle search server 50 reads and acquires the corresponding vehicle information from the case DB 56*b* based on the request sent from the client terminal 90 in Step St26-1. Here, the vehicle information includes, for example, a case information including the bibliographic information BIB11 and BIB12 (see FIGS. 26 to 28) relating to the case, the vehicle thumbnail image, the information on the rank of the suspect candidate mark, the map information, the information on the flow-in/flow-out direction, the information on the place name, the information on the time when the vehicle passes through the intersection, and the information on various memos inputted by a user every time. The vehicle search server 50 sends those pieces of the vehicle information to the client terminal 90 via the communication unit 51.

The processor 92 of the client terminal 90 receives and acquires the vehicle information sent from the vehicle search server 50 via the communication unit 93 (St26-2). After Step St26-2 is performed, the processor 92 creates a temporary data file for creating the data of the case report (St26-3) and arranges the case information included in the vehicle information at a predetermined position on a predetermined layout of the temporary data file (St26-4).

In addition, the processor 92 repeatedly executes the processing of Steps St26-5, St26-6, and St26-7 for each vehicle thumbnail image included in the vehicle information. Specifically, the processor 92 arranges the vehicle thumbnail image, the road map MP1, and the suspect candidate mark at predetermined positions on the predetermined layout of the temporary data file for each vehicle thumbnail image (St26-5). Next, the processor 92 arranges the arrow (direction) of the flow-in/flow-out direction on the road map MP1 at the predetermined position on the predetermined layout of the temporary data file in a superimposed manner for each vehicle thumbnail image (St26-6). Further, the processor 92 arranges the information on the place name, the passing time, and the memo at predetermined positions on the predetermined layout of the temporary data file for each vehicle thumbnail image (St26-7).

The processor 92 executes the processing of Steps St26-5 to St26-7 for each vehicle thumbnail image and then outputs the temporary data file as the case report (St26-8). As a result, the processor 92 can create and output the case report based on a user's operation.

As described above, the vehicle detection system 100 according to Modification Example 1 of the first embodiment includes the vehicle search server 50 connected to be able to communicate with the cameras 10, 10*a*, . . . installed at intersections and the client terminal 90 connected to be able to communicate with the vehicle search server 50. In accordance with the input of information including the date and time and the location at which an incident or the like occurs and the features of the vehicle causing the incident or the like, the client terminal 90 sends an information acquisition request of the vehicle which passes through the intersection at the location at the date and time to the vehicle search server 50. Based on the information acquisition request, the vehicle search server 50 extracts the vehicle information and the passing direction of a plurality of vehicles passing through the intersection at the location in association with each other by using the captured images of the camera corresponding to the intersection at the location at the date and time and sends the extraction result to the client terminal 90. The client terminal 90 creates and outputs a case report (an example of the vehicle candidate report) including the extraction result and the input information.

Therefore, when an incident or the like occurs at an intersection where many people and vehicles come and go, it is possible to create the case report correlating the captured images of the vehicle candidates or the likes extracted as the getaway vehicle and the getaway direction when the vehicle passes through the intersection in the client terminal 90 used by him or herself. Therefore, the vehicle detection system 100 can record various tasks related to extraction of the getaway vehicle or the like in the investigation by a user, so that the convenience of police investigation and the like can be accurately improved.

The client terminal 90 displays the visual features of the plurality of vehicles passing through the intersection at the location and the passing directions of the respective vehicles on the display 94 by using the extraction result. Therefore, a user can simultaneously grasp, at an early stage, the visual features of the vehicle candidates or the likes extracted as the getaway vehicle and the getaway direction at the time of passing through the intersection.

In addition, the client terminal 90 displays a still image illustrating the appearance of each vehicle as the visual information of the plurality of vehicles. As a result, a user can visually and intuitively grasp the still image (for example, a vehicle thumbnail image) illustrating the appearance of the vehicle while searching for the getaway vehicle and can quickly determine the presence or absence of a suspicious getaway vehicle.

Further, the client terminal 90 holds the information on the road map MP1 indicating the position of the intersection at which the camera is installed and displays the passing direction on the road map of the predetermined range including the intersection at the location in a superimposed manner. Therefore, when a user searches for the getaway vehicle, the user can grasp the position on the road map MP of the intersection where the vehicle has passed in contrast with the appearance (that is, the vehicle thumbnail image) of the vehicle, and thus it is possible to accurately grasp the position of the intersection where the vehicle with suspicion of the getaway vehicle has passed.

Further, the client terminal 90 displays the suspect candidate mark of the vehicle on which a suspect of an incident rides, in the vicinity of the vehicle in response to a user's operation on the visual information of the vehicle displayed on the display 94. Therefore, a user can assign the suspect candidate mark to the thumbnail image of the vehicle with possibility of the getaway vehicle on which the suspect of an incident or the like rides, it is possible to easily check the vehicles concerned when looking back the plurality of vehicle thumbnail images obtained as the search results, and thus the convenience at the time of investigation is improved.

Further, the client terminal 90 switches and displays the type of the suspect candidate mark indicating the possibility of being a suspect in response to a user's operation on the suspect candidate mark. As a result, a user can change the rank of the suspect candidate mark for convenience under the determination that the vehicle to which the suspect candidate mark is given is highly likely or is likely to be the getaway vehicle. Therefore, for example, suspect candidate marks which can distinguish vehicles of particular concern or vehicles which are not so concerned can be given, and thus the convenience at the time of investigation is improved.

Further, the client terminal 90 creates the case report in which the vehicle candidates are narrowed down to at least one vehicle to which the suspect candidate mark of the same type is set in response to a user's operation on a case report (an example of the vehicle candidate report) creation icon. Therefore, a user can create the case report collecting the list of vehicle candidates suspicious to the same extent of possibility of the getaway vehicle, and thus the convenience at the time of investigation is improved.

The client terminal 90 hides the display of the visual feature of the vehicle and the passing direction of the vehicle in response to a user's operation on the visual information of at least one vehicle displayed on the display 94 and creates a vehicle candidate report in which the vehicle candidates are narrowed down to the remaining vehicles other than the non-displayed vehicle. Therefore, when, for example, information on vehicles unrelated to the case such as the incident can be obtained, a user can accurately improve the investigation quality by hiding (that is, deleting) and filtering the vehicle thumbnail image and passing direction unrelated to the case from the case screen WD3, and thus it is possible to improve the perfection and reliability of the case report.

Hereinbefore, various embodiments are described with reference to the drawings. However, it goes without saying that the present disclosure is not limited to such examples. Those skilled in the art will appreciate that various modification examples, correction examples, substitution examples, addition examples, deletion examples, and equivalent examples can be conceived within the scope described in the claims and it is understood that those are also within the technical scope of the present disclosure. Further, respective constituent elements in the various embodiments described above may be arbitrarily combined within the scope not deviating from the gist of the invention.

In the first embodiment and the modification example described above, it is exemplified that the detection target object in the captured images of the cameras 10, 10*a*, . . . is a vehicle. However, the detection target object is not limited to a vehicle but may be another object (for example, a moving object such as a vehicle). The "another object" may be, for example, a flying object such as a drone operated by a person such as a suspect who caused an incident or the like. That is, the vehicle detection system according to the embodiments can also be called an investigation support system which supports detection of a vehicle or other target objects (that is, detection target objects).

The present disclosure is useful as a vehicle detection system and a vehicle detection method which accurately improve the convenience of investigation by police and others by efficiently supporting early grasp of the visual features and getaway direction of a getaway vehicle or the like when an incident or the like occurs at an intersection where many people and vehicles come and go.

This present application is based upon Japanese Patent Application (Patent Application No. 2018-151842) filed on Aug. 10, 2018, the contents of which are incorporated by reference.

What is claimed is:

1. A vehicle detection system, comprising:

a server configured to communicate with a camera installed at an intersection; and a client terminal configured to communicate with the server, wherein the client terminal is configured to send, in response to input of information including date and time and a location at which an incident occurred and a feature of a vehicle which caused the incident, an information acquisition request relating to a vehicle which passes through the intersection at the location at the date and time to the server;

wherein the server is configured to extract vehicle information and a-passing directions of the vehicle passing through the intersection at the location in association with each other based on a captured image of the camera installed at the intersection at the location at the date and time in response to a reception of the information acquisition request, and to send an extraction result to the client terminal;

wherein the passing directions includes a flow-in direction that indicates a direction in which the vehicle enters the intersection, and a flow-out direction that indicates a direction in which the vehicle exits the intersection;

wherein the client terminal is configured to display a visual feature of the vehicle passing through the intersection at the location and the passing directions of the vehicle on a display device based on the extraction result; and wherein the visual feature includes indicators, which indicate the flow-in direction and the flow-out direction, superimposed over an image of the intersection.

2. The vehicle detection system according to claim 1, wherein the client terminal is configured to display a still image illustrating an appearance of the vehicle as visual information of the vehicle on the display device.

3. The vehicle detection system according to claim 1, wherein the client terminal is configured to store information on a road map indicating a position of the intersection at which the camera is installed, and to display the indicators superimposed on the road map in a predetermined range including the intersection at the location.

4. The vehicle detection system according to claim 1, wherein the client terminal is configured to create the information acquisition request based on the passing directions of the vehicle passing through the intersection at the location.

5. The vehicle detection system according to claim 2, wherein the client terminal is configured to display a candidate mark of a vehicle on which a suspect of the incident rides in the vicinity of the vehicle in response to a user's operation on the visual information of the vehicle displayed on the display device.

6. The vehicle detection system according to claim 5, wherein the client terminal is configured to switch and display a type of the candidate mark indicating possibility of being the suspect in response to a user's operation on the candidate mark.

7. The vehicle detection system according to claim 2, wherein the client terminal is configured to display a reproduction icon superimposed on the visual information of the vehicle in response to a user's operation on the visual information of the vehicle displayed on the display device; and wherein the reproduction icon is configured to instruct reproduction of a captured image of a camera which captures the vehicle.

8. The vehicle detection system according to claim 2, wherein the client terminal is configured to hide a display of the visual feature of the vehicle and the passing direction of the vehicle on the display device in response to a user's operation on the visual information of the vehicle displayed on the display device.

9. The vehicle detection system according to claim 1, wherein the client terminal is configured to display on the display device the visual feature of the vehicle passing through the intersection at the location, the passing direction of the vehicle, and the input information in association with one another.

10. The vehicle detection system according to claim 2, wherein the client terminal is configured to display on the display device an image reproduction dialog including a reproduction screen of the captured image of the camera installed at the intersection at the location as the visual information of the vehicle.

11. The vehicle detection system according to claim 10, wherein the client terminal is configured to store information on a road map indicating a position of the intersection at which the camera is installed and to display a screen in which the indicators are superimposed on the road map in a predetermined range including the intersection at the location in the image reproduction dialog.

12. The vehicle detection system according to claim 10, wherein the client terminal is configured to display and reproduce an image for a predetermined period from when the vehicle enters into the intersection to when the vehicle exits from the intersection on the reproduction screen.

13. The vehicle detection system according to claim 11, wherein the client terminal is configured to rotate and display the road map so as to coincide with a direction of an imaging angle of view of the camera in response to a user's operation on the road map.

14. The vehicle detection system according to claim 10, wherein the client terminal is configured to display a candidate mark of a vehicle on which a suspect of the incident rides in the vicinity of the reproduction screen in response to a user's operation on the image reproduction dialog.

15. The vehicle detection system according to claim 10, wherein the client terminal is configured to change and display the passing direction of the vehicle in response to a user's operation on the image reproduction dialogue.

16. The vehicle detection system according to claim 10, wherein the client terminal is configured to communicate with a video recorder for recording the captured image of the camera, acquire the captured image of the camera from the video recorder, and display and reproduce another video reproduction screen different from the image reproduction dialog in response to a user's operation on the video reproduction dialog.

17. The vehicle detection system according to claim 16, wherein the client terminal is configured to hide the another image reproduction screen in response to a user's operation for hiding the image reproduction dialog.

18. The vehicle detection system according to claim 12, wherein the client terminal is configured to display a frame of a predetermined shape superimposed on the vehicle while the vehicle enters into the intersection and exits from the intersection.

19. The vehicle detection system according to claim 1, wherein the visual feature includes a name of a location of the intersection adjacent to the image of the intersection.

20. A vehicle detection method implemented by a vehicle detection system which includes a server configured to communicate with a camera installed at an intersection and a client terminal configured to communicate with the server, the method comprising:

sending, in response to input of information including date and time and a location at which an incident occurred and a feature of a vehicle which caused the incident, an information acquisition request of a vehicle which passes through the intersection at a location at date and time to the server;

extracting vehicle information and passing directions of the vehicle passing through the intersection at the location based on a captured image of the camera installed at the intersection at the location in association with each other at the date and time in response to a reception of the information acquisition request, the passing directions including a flow-in direction that indicates a direction in which the vehicle enters the intersection, and a flow-out direction that indicates a direction in which the vehicle exits the intersection;

sending an extraction result to the client terminal; and displaying a visual feature of the vehicle passing through the intersection at the location and the passing direction of the vehicle on a display device using the extraction result, the visual feature including indicators, which indicate the flow-in direction and the flow-out direction, superimposed over an image of the intersection.

21. A vehicle detection system, comprising:

a server configured to communicate with a camera installed at an intersection; and a client terminal configured to communicate with the server, wherein the client terminal is configured to send, in response to input of information including date and time and a location at which an incident occurred and a feature of a vehicle which caused the incident, an information acquisition request relating to a vehicle which passes through the intersection at the location at the date and time to the server;

wherein the server is configured to extract vehicle information and passing directions of a plurality of vehicles which pass through the intersection in association with each other at the location based on a captured image of the camera installed at the intersection at the location at the date and time in response to a reception of the information acquisition request and to send an extraction result to the client terminal;

wherein the passing directions of the plurality of vehicles includes flow-in directions that indicates directions in which the plurality of vehicles enter the intersection, and a flow-out directions that indicates directions in which the plurality of vehicles exit the intersection;

wherein the client terminal is configured to create and output a vehicle candidate report including the extraction result and the input information; and wherein the client terminal is configured to display, on a display device, indicators, which indicate the flow-in directions and the flow-out directions, superimposed over images of the intersection.

* * * * *